US008695947B2

(12) United States Patent
Bishop

(10) Patent No.: US 8,695,947 B2
(45) **Date of Patent: *Apr. 15, 2014**

(54) SECURITY BARRIER SYSTEM

(75) Inventor: Justin Bishop, West Caldwell, NJ (US)

(73) Assignee: Halo Maritime Defense Systems, Newton, NH (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/273,681

(22) Filed: Oct. 14, 2011

(65) Prior Publication Data

US 2012/0091412 A1 Apr. 19, 2012

Related U.S. Application Data

(60) Provisional application No. 61/393,193, filed on Oct. 14, 2010.

(51) Int. Cl.
*E02B 3/00* (2006.01)

(52) U.S. Cl.
USPC ..... 256/13; 256/23; 114/240 R; 405/26

(58) Field of Classification Search
USPC ..... 114/240 R, 240 D, 240 A, 240 B; 405/21, 405/25, 26, 27, 30; 256/13, 23
See application file for complete search history.

(56) References Cited

U.S. PATENT DOCUMENTS 2,693,161 A * 11/1954 Stubbs ..... 405/71
3,864,049 A * 2/1975 Ono ..... 403/171
4,033,137 A * 7/1977 Geist ..... 405/71
4,174,185 A * 11/1979 Toki ..... 405/27
4,272,214 A * 6/1981 Nyfeldt et al. ..... 405/72
4,425,053 A * 1/1984 Muto et al. ..... 405/63
5,429,452 A * 7/1995 Frost ..... 405/26
5,651,709 A * 7/1997 Nandakumar et al. ..... 441/5
5,827,011 A * 10/1998 Kann ..... 405/27
6,102,616 A * 8/2000 Foote ..... 405/26
6,886,484 B2 * 5/2005 Thomas ..... 114/108
6,960,047 B2 * 11/2005 Knezek et al. ..... 405/211
7,401,565 B2 * 7/2008 Nixon et al. ..... 114/241
7,451,527 B2 11/2008 Pearce et al.
7,481,176 B2 1/2009 Pratt et al.

(Continued)

OTHER PUBLICATIONS

Transmittal of the International Search Report and the Written Opinion of the International Searching Authority issued in PCT/US2011/056300 dated Feb. 24, 2012.

(Continued)

*Primary Examiner* — Joshua Kennedy
(74) *Attorney, Agent, or Firm* — Miles & Stockbridge P.C.

(57) ABSTRACT

A security barrier system includes a security barrier unit including a first panel group, a second panel group, a connecting member for connecting the first panel group and the second panel group. The first and second panel groups are disposed substantially in parallel and face each other. Each of the first and second panel groups includes one or more sub-panel groups, each of which includes barrier panels arranged in line, intermediate members each disposed between adjacent barrier panels, rope tubes and ropes. Each barrier panel has a front face, a rear face and side faces and has channels passing through from one side face to another side face. The rope tubes are disposed in the channels, respectively, so that the rope tubes pass through the barrier panels and the intermediate members. The barrier panels and the intermediate members are connected by the ropes disposed in the rope tubes.

44 Claims, 34 Drawing Sheets

(56) References Cited

U.S. PATENT DOCUMENTS

| | | | | |
|---|---|---|---|---|
| 7,524,139 | B2 * | 4/2009 | Bishop | 405/21 |
| 7,524,140 | B2 * | 4/2009 | Bishop | 405/30 |
| 7,572,083 | B1 * | 8/2009 | Bishop et al. | 405/26 |
| 7,726,910 | B2 | 6/2010 | Foo et al. | |
| 7,887,254 | B2 | 2/2011 | Bishop | |
| 7,975,639 | B2 | 7/2011 | Bishop | |
| 8,007,202 | B2 * | 8/2011 | Davis et al. | 405/63 |
| 8,020,836 | B2 * | 9/2011 | Bishop | 256/13 |
| 2003/0190191 | A1 * | 10/2003 | Clark | 405/26 |
| 2005/0013668 | A1 * | 1/2005 | Nixon et al. | 405/218 |
| 2006/0037526 | A1 * | 2/2006 | Knezek et al. | 114/267 |
| 2009/0090059 | A1 | 4/2009 | Bishop | |
| 2010/0059728 | A1 * | 3/2010 | Bishop | 256/24 |

OTHER PUBLICATIONS

Written Opinion of the International Searching Authority issued in PCT/US2011/056300 dated Feb. 24, 2012.

Global Search Report issued in PCT-US2011-56300 dated Feb. 12, 2012.

International Preliminary Report on Patentability issued in PCT Application No. PCT/US2011/056300, mailed Apr. 16, 2013.

* cited by examiner

SECURITY BARRIER SYSTEM

This application claims priority of U.S. Provisional Application No. 61/393,193 filed on Oct. 14, 2010, the entire content of which is hereby incorporated by reference herein.

TECHNICAL FIELD

The present disclosure relates to security barrier systems on water and/or land, particularly systems deployed on water. More specifically, the present disclosure relates to a security barrier system and components thereof. The security barrier system has particular applicability to a maritime security barrier for stopping a vehicle, for example, a boat, from penetrating a secured area.

BACKGROUND

Structures for use on both land and/or water as security barrier systems have been previously developed. Such structures generally intend to stop intruding objects, and range from thick, solid walls blocking the object's progress to secured areas for disabling the propelling mechanism of the object. These structures commonly exhibit noticeable shortcomings. First, these structures are often cumbersome and time-consuming to install and erect as and where desired. Second, they are difficult, or even impossible, to maintain, and/or repair after they have sustained the impact of an intruding object. Third, they are often not adaptable to different needs and conditions.

Therefore, a need exist for improved security barriers and security barrier systems which remain effective while overcoming such shortcomings.

The security barrier systems and the components thereof disclosed in U.S. Pat. Nos. 7,524,139; 7,524,140; 7,887,254; 7,975,639; and 8,020,836, and U.S. application Ser. No. 11/879,271, generally relate to the present disclosure, the entire disclosures of which are hereby incorporated by reference herein.

SUMMARY

The present disclosure provides a security barrier system that addresses the aforementioned problems, and provides an improved security barrier system and components thereof for maritime use.

Examples of the present subject matter include a security system/barrier for use on water and/or land, preferably deployed on water, and describe an improved apparatus and method for this purpose. The present subject matter may be utilized in countering terrorism. Unwelcome objects, such as land and sea vehicles, attempting to intrude into populated, secure, or sensitive areas are commonly employed in terrorist activities. As part of efforts to counter terrorism, there is an urgent need to prevent penetration of such objects into such populated, secure, or sensitive area. One or more examples of this disclosure will aid in this prevention.

In one example, a security barrier system includes a security barrier unit. The security barrier unit includes a first panel group, a second panel group and a connecting member for connecting the first panel group and the second panel group. The first panel group and the second panel group are disposed substantially in parallel and face each other.

Each of the first and second panel groups includes one or more sub-panel groups. Each of the sub-panel groups includes barrier panels arranged in line, intermediate members each disposed between adjacent barrier panels, rope tubes and one or more ropes. Each of the barrier panels has a front face, a rear face and side faces and has channels passing through from one side face to another side face. The rope tubes are disposed in the channels, respectively, so that the rope tubes pass through the barrier panels and the intermediate members. The barrier panels and the intermediate members are connected by the one or more ropes disposed in at least one of the rope tubes, respectively.

In the above security barrier system, the intermediate members may include at least one midpoint mooring member having a connection portion for attaching an anchor system for anchoring the security barrier to a sea bed. In any of the above security barrier system, the security barrier unit may further include an anchor system for anchoring the security barrier to a sea bed, and the intermediate members may include at least one midpoint mooring member having a connection portion connected to the anchor system.

In any of the above security barrier system, each of the barrier panels may be made of an ablative material which is breakable upon impact. Each of the barrier panels may have a multilayer structure, a fiberglass structure or a honeycomb structure.

In any of the above security barrier system, each of the sub-panel groups may further include a strap wound around each of the rope tubes so as to limit motion of the rope tubes during an impact. The strap may be a webbing made of polyester, nylon or rubber.

In any of the above security barrier system, each of the sub-panel groups may further include an end member disposed on the end of each of the sub-panel groups. The rope tubes may be fixed to the end member. Each of the rope tubes may have a thread end, and may be adjustably fixed to the end member by a thread nut for engaging the thread end.

In any of the above security barrier system, the end member may include lugs, and each of the lugs may have a hole for accommodating a connector pin. The sub-panel groups may be connected by passing through the connector pin into the hole of each of the lugs of adjacent sub-panel groups. The connector pin may include a core rod surrounded by an elastic material such as rubber and an outer tube made of, for example, plastic.

In any of the above security barrier system, the connecting member may include at least one of a vertical truss and a diagonal truss. The vertical truss may be attached between one of the barrier panels in the first panel group and one of the barrier panels in the second panel group. The diagonal truss may be attached between two of the barrier panels in the first panel group and two of the barrier panels in the second panel group. At least one of the vertical truss and the diagonal truss may include two poles connected by two or more struts.

In any of the above security barrier system, the security barrier unit may further include a cable connecting the first panel group and the second panel group.

In any of the above security barrier system, at least one of the one or more ropes may have one end fixed to one end of a corresponding one of the rope tubes in which the at least one of the one or more ropes is inserted, and another end adjustably connected to another end of the corresponding one of the rope tubes, so that tension of the at least one of the one or more rope tubes is adjusted. A material of at least one of the rope tubes may be different from a material of at least another one of the rope tubes.

In any of the above security barrier system, the connecting member may include a pair of wedge-shaped buoys. Each of the pair of wedge-shaped buoys has a shorter end and a longer end. The pair of wedge-shaped buoys may be stacked so that the shorter end of one of the pair of wedge-shaped buoys is attached to the longer end of another one of the pair of wedge-shaped buoys. Each of the pair of wedge-shaped buoys may further include through holes at each of the shorter end and the longer end so that the rope tubes pass through the through holes, respectively.

In any of the above security barrier system, the connecting member includes a plurality of wedge-shaped buoys. Each of the plurality of wedge-shaped buoys has a shorter end and a longer end, and the plurality of wedge-shaped buoys may be stacked so that shorter ends of the plurality of wedge-shaped buoys are stacked and longer ends of the plurality of wedge-shaped buoys are stacked, respectively, thereby changing a direction of the first and second panel groups. Each of the plurality of wedge-shaped buoys may further include through holes at each of the shorter end and the longer end, so that the rope tubes passes through the through holes, respectively.

In any of the above security barrier system, each of the wedge-shaped buoys has a wedge angle substantially equal to 90°/n (n is an integer).

In any of the above security barrier system, the security barrier system may further include opening gate structure having an opening portion. The security barrier unit may be disposed so as to open and close the opening portion.

The security barrier unit may be slidably disposed. The opening gate structure may include two barrier sections, each of which has a docking station for accommodating the security barrier unit. Each docking station may include a winch for pulling a cable attached to the security barrier unit. The security barrier unit may further include a bridle disposed at ends of the first and second panel groups, and the cable may be attached to the bridle. In some cases, the security barrier unit may be hinged to the opening gate structure.

In any of the above security barrier system, each of the barrier panels may include a top portion and a bottom buoyancy portion giving buoyancy to each of the barrier panels.

A connector pin is one of the components of the security barrier system. The connector pin includes a core rod surrounded by an elastic material such as rubber, an outer tube (e.g., plastic tube), end plates disposed at both ends of the connector pin, respectively, and shackles connected to the end plate, respectively. The end plates have a larger diameter than the outer tube, and at least one of the end plates is detachable from the connector pin.

Rope tube assembly is also one of the components of the security barrier system. The rope tube assembly includes a tube and a rope disposed inside the tube. One end of the rope is fixed to one end of the tube, and another end of the rope is adjustably connected to the other end of the tube so that tension of the rope is adjusted.

In the above rope tube assembly, the rope tube assembly may further include a washer nut. The other end of the rope may include an anchor extension having a threaded end, and the tension can be adjusted by engaging the threaded end and the washer nut.

In any of the above rope tube assembly, the rope tube assembly may further include an anchor nut threading on an outer surface of at least one end of the tube for fixing the rope tube assembly to the security barrier system.

In the above rope tube assembly, a resin may be disposed between the rope and the anchor extension.

A wedge-shaped buoy can also be one of the components of the security barrier system. The wedge-shaped buy has a shorter end portion, a longer end portion having a longer width than the shorter end portion, and a body connecting the shorter end portion and the longer end portion, thereby forming a substantially wedge-shape. The shorter end portion and the longer end portion have openings, respectively, and the openings of the shorter end portion are disposed at the same height as the openings of the longer end portion, respectively.

In the above wedge-shaped buoy, the body may have a plurality of openings.

In the above wedge-shaped buoy, a wedge angle of the wedge-shaped buoy may be substantially equal to 90°/n (n is an integer).

In another example, a security barrier panel unit includes one or more sub-panel groups. Each of the sub-panel groups includes barrier panels arranged in line, intermediate members each disposed between adjacent barrier panels, rope tubes and one or more ropes. Each of the barrier panels has a front face, a rear face and side faces and has channels passing through from one side face to another side face. The rope tubes are disposed in the channels, respectively, so that the rope tubes pass through the barrier panels and the intermediate members. The barrier panels and the intermediate members are connected by the one or more ropes disposed in at least one of the rope tubes, respectively. Any of the foregoing intermediate members, end member, connector pin, rope tubes and/or ropes may be applied to the security barrier panel unit.

The security barrier systems and components thereof of the present disclosure, together with further objects and advantages, can be better understood by reference to the following detailed description and the accompanying drawings.

BRIEF DESCRIPTION OF THE DRAWINGS

The drawing figures depict one or more implementations in accord with the present teachings, by way of example only, not by way of limitation. In the figures, like reference numerals refer to the same or similar elements.

DETAILED DESCRIPTION

General Description

Figure 1C:
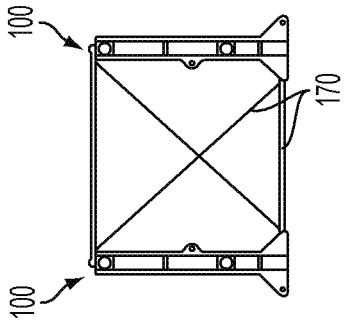
FIGS. 1C and 1D show side views at lines A and B of FIG. 1B, respectively.
Figure 1D:
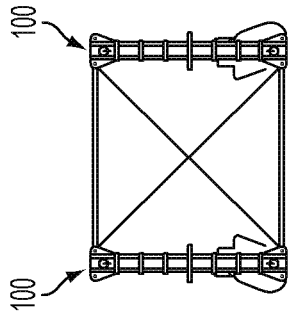
Figure 1A:
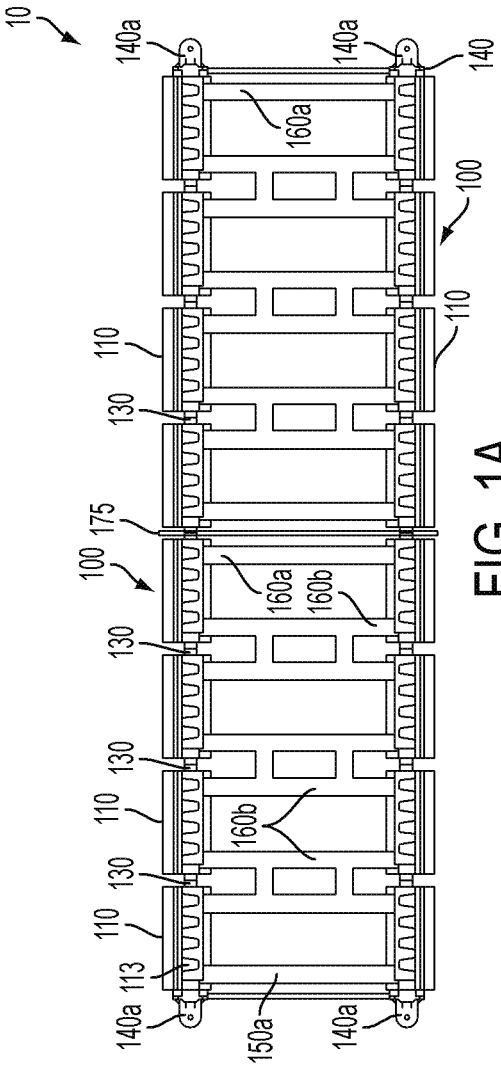
FIG. 1A shows an exemplary top view of a security barrier gate in accordance with one example of the present disclosure.
Figure 1B:
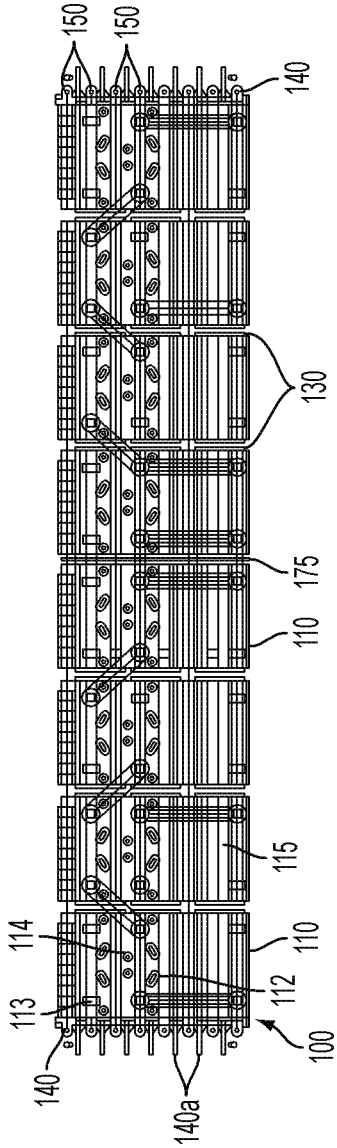
FIG. 1B shows an exemplary front view of the security barrier gate of FIG.1A.
Figure 2A:
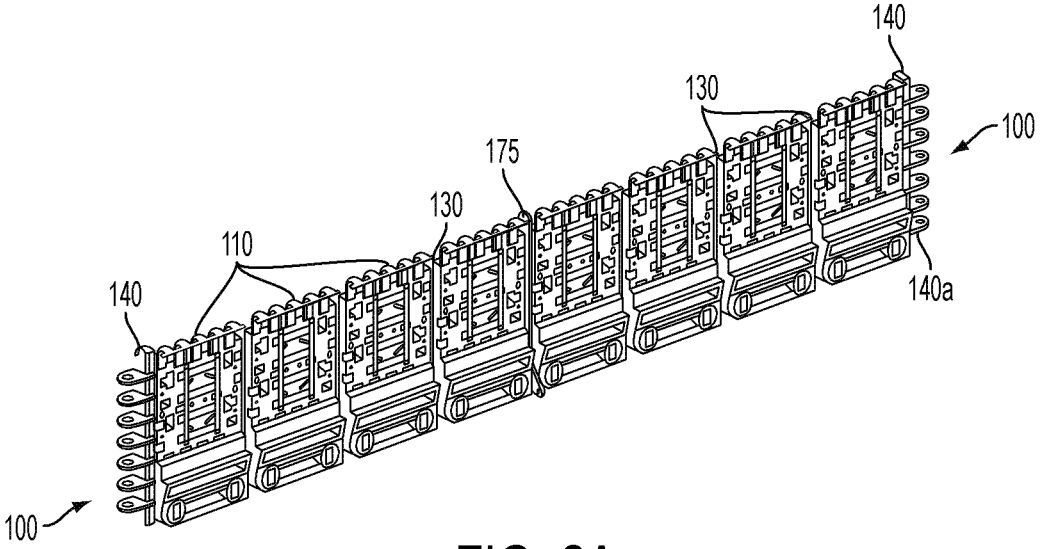
FIG. 2A shows an exemplary perspective view of a sub-panel group in accordance with one example of the present disclosure
Figure 2B:
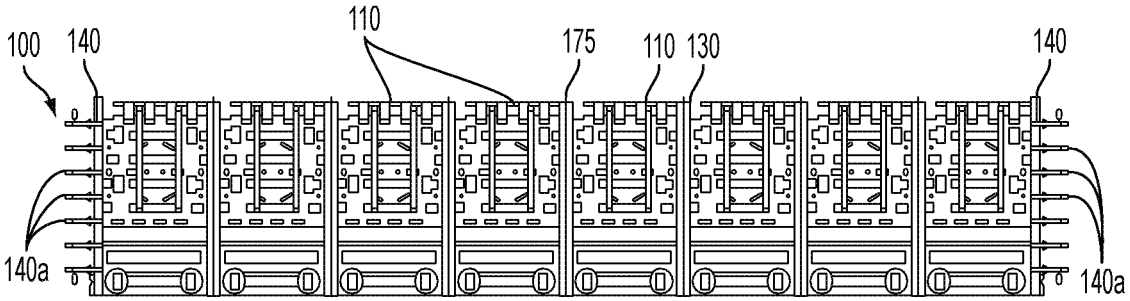
FIG. 2B shows a front view of the sub-panel group of FIG. 2A.
Figure 2C:
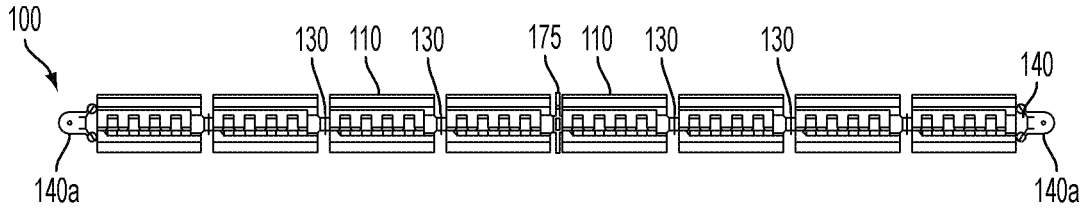
FIG. 2C shows a top view of the sub-panel group of FIG. 2A.
Figure 2D:
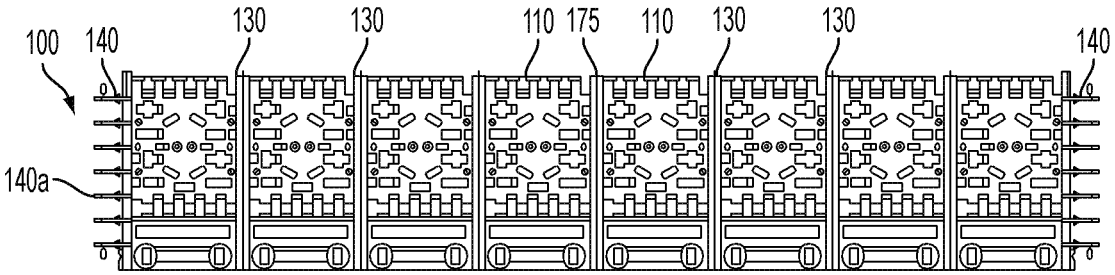
FIG. 2D shows a rear view of the sub-panel group of FIG. 2A.
Figure 2E:
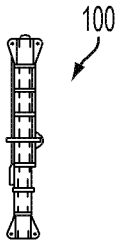
FIG. 2E shows a side view of the sub-panel group of FIG. 2A.

In the following detailed description, numerous specific details are set forth by way of examples in order to provide a thorough understanding of the relevant teachings. However, it should be apparent to those skilled in the art that the present teachings may be practiced without such details. In other instances, well known methods, procedures, components, and/or materials have been described at a relatively high-level, without detail, in order to avoid unnecessarily obscuring aspects of the present teachings.

Accordingly to one example of the security barrier system of the present disclosure, as shown in FIGS. 1A-1D, a security barrier system includes two panel groups 10 arranged in parallel forming two rows. In this example, the two panel groups 10 are identical. However, configuration of the panel groups may be different from one panel group to another. Each of the panel groups 10 includes sub-panel groups 100. FIGS. 2A-2E illustrate one of the sub-panel groups 100. Each of the sub-panel groups 100 constitutes of plural barrier panels 110 arranged side-by-side. In FIGS. 1 and 2, for example, each sub-panel group 100 includes eight (8) barrier panels 110.

Each barrier panel is, for example, four (4) feet long and eight (8) feet high. Preferably, each of the barrier panels 110 is hollow to reduce weight. Each of the barrier panels 110 further has one or more openings 112, 113 and 114 at a top portion thereof for attenuating and absorbing wave energy coming to the barrier panel. The features and functions of the wave attenuation and energy absorption of the barrier panel 110 are generally described, for example, in U.S. Pat. No. 7,524,140. A bottom portion of the barrier panel is a buoyancy portion 115 for giving buoyancy to the barrier panel. The buoyancy portion 115 may include one or more pieces of foam 116. The foam 116 inside of the buoyancy portion helps to absorb impact energy and distributes that energy radially from the point of impact to trusses and stay cables.

The barrier panels 110 are made of, for example, plastic. Preferably, the barrier panels 110 are made of a blast-resistant material, for example, but not limited to, an ablative material.

Ablative materials are composites of multiple materials, for example, high-density polyethylene (HDPE), ultra-high molecular weight polyethylene (UHMPE) such as Spectra®, a ceramic, a fiberglass or any combination thereof. Each layer of the composites may perform a different function, for example, blast resistance, ballistic resistance or fire resistance. Any of these materials may form a multilayer structure. According to a purpose of the security barrier or a place where the security barrier is placed, each material in the composites is selected. When an ablative material is used for the barrier panels, when an object (for example, a boat) impacts the barrier panel, the barrier panel can effectively absorb the impact energy by ablating. Examples of the ablative material are HDPE, UHMPE such as Spectra® and Dyneema®, a glass fiber, rubber, ceramic, a carbon fiber including a para-aramid synthetic fiber such as Kevlar®, urethane foam, Surlyn®, a high strength steel, or aluminum.

Figure 3A:
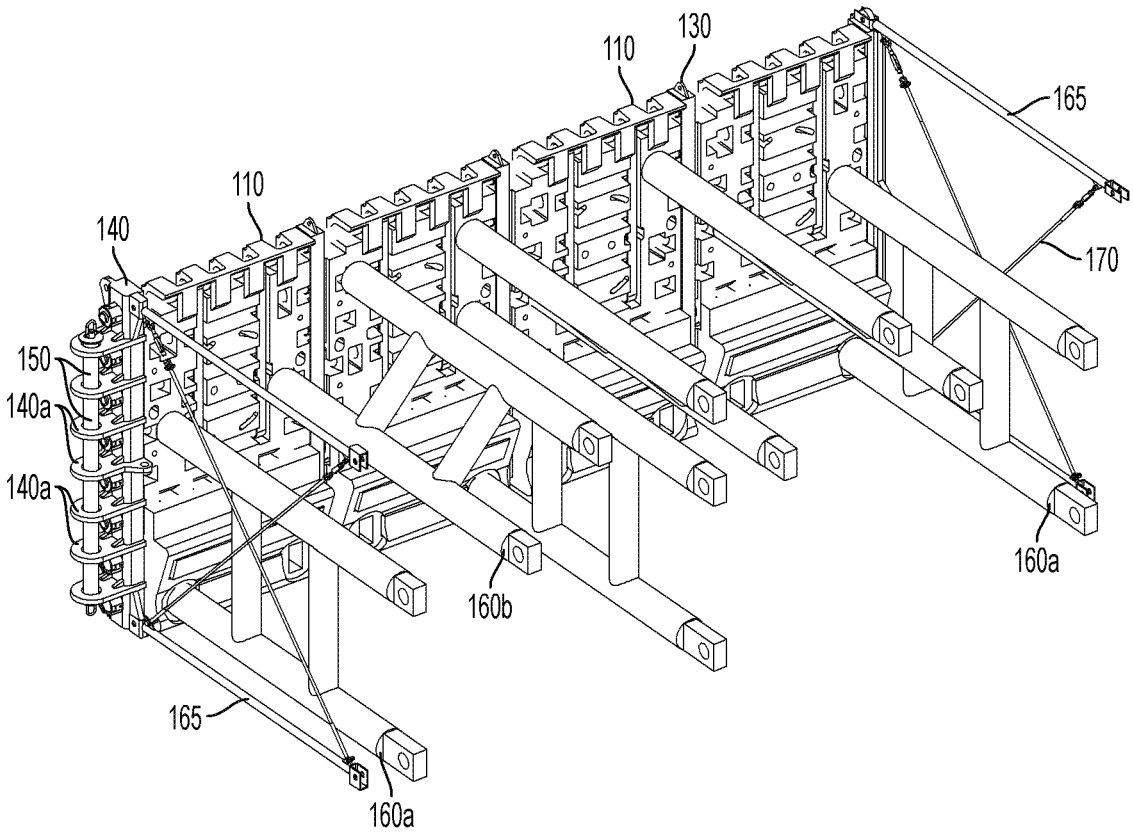
FIG. 3 shows an exemplary detailed view of the security barrier panel group.
Figure 3B:
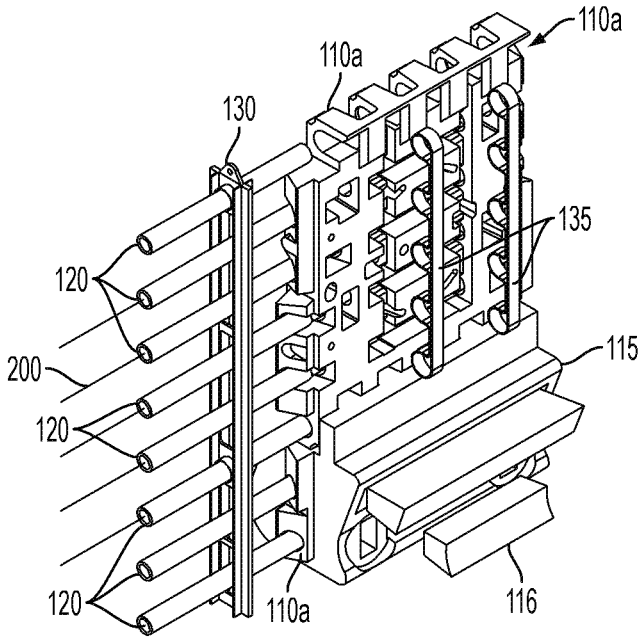

Each of the barrier panels 110 has a front face, a rear face, a top face, a bottom face and side faces. As shown in FIGS. 3A and 3B, each of the barrier panels 110 has longitudinal channels 110*a* passing through between the side faces. In this example, eight (8) channels are provided in one barrier panel, but the number of channels is not limited to eight. In FIG. 3B, two of the channels pass through the buoyancy portion 115.

The channels 110*a* are provided to accommodate rope tubes 120. As shown in FIG. 3B, eight rope tubes 120 are inserted into the corresponding channels 110*a*, respectively. The rope tubes 120 pass through eight barrier panels as shown in FIGS. 1 and 2 from one end of the sub-panel group 100 to the other end of the sub-panel group 100.

The rope tubes 120 also pass through intermediate members including a midpoint mooring member 175 and transfer beams 130 as shown in FIG. 2. The intermediate members are provided between the barrier panels, respectively. When eight barrier panels 100 are connected, six transfer beams 130 and one midpoint mooring member 175 are provided. The midpoint mooring member 175 is preferably disposed at the center of the sub-panel group 100. The configuration of a transfer beam is different from that of the midpoint mooring member but alternatively can be the same as that of the midpoint mooring member. The intermediate member can be integrated with the barrier panel in an undetachable manner.

The rope tubes 120 pass through the barrier panels 110 as well as the transfer beams 130 and the midpoint mooring member 175. Inside the rope tube 120 is provided with a rope 200. The rope tubes 120 can prevent the rope 200 from being damaged by blast, ballistics or fire. The rope tube 120 may contain a communication or a power cable.

Further, at the ends of the sub-panel group 100, end members 140 are attached, respectively. The eight barrier panels 110 and intermediate members 130 and 175 are secured by attaching the rope tubes 120 to the end members 140.

Two or more sub-panel groups 100 may be connected to form a panel group 10, and a pair of the panel groups 10 can be joined to each other by connecting members such as a series of vertical trusses 160*a* and diagonal trusses 160*b* so that the pair of the panel groups 10 are arranged in parallel and form two rows as shown in FIG. 1. Further, a stay cable 170 may be provided between two panel groups. The end members 140 may also be connected by a beam 165 which may also be used between intermediate members 130 or 175.

Each of the above components of the security barrier system is described in detail as follows.

Truss

Figure 4:
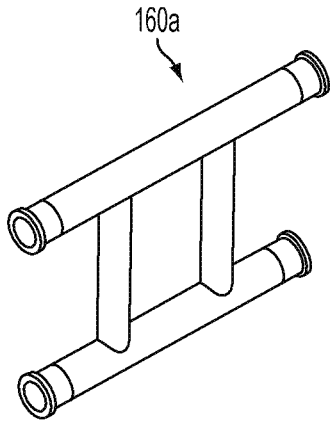
FIG. 4 shows an exemplary view of a vertical truss in accordance with one example of the present disclosure.
Figure 5:
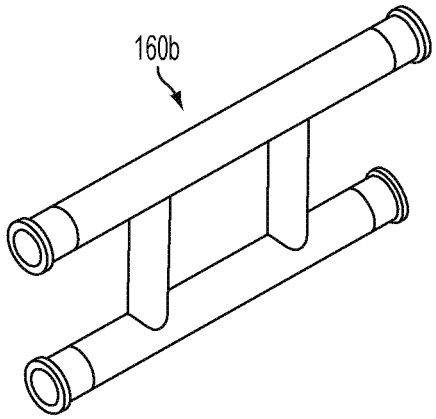
FIG. 5 shows an exemplary view of a diagonal truss in accordance with one example of the present disclosure.

Trusses are components of the security barrier system that connect two panel groups (e.g., a first panel group and a second panel group) as a connecting member. Exemplary trusses are shown in FIGS. 4 and 5. The vertical trusses 160*a* may have a generally ladder shape and have two poles connected by two or more struts. The first ends of the two poles are attachable to one of the barrier panels 110 in the first panel group 10 and the second ends of the two poles are attachable to one of the barrier panels 110 in the second panel group 10 (see, FIGS. 1A and 3A). The diagonal trusses 160*b* may also have a generally ladder shape and have two poles connected by two or more struts. The first ends of the two poles are attachable to two adjacent barrier panels 110 in the first panel group 10 and the second ends of the two poles are attachable to two adjacent barrier panels 110 in the second panel group 10 (see, FIGS. 1A and 3A). The diagonal trusses 160*b* give additional horizontal integrity of the barrier panels 110. Alternately, the vertical or diagonal truss may be a single pole.

The trusses are made of, for example, plastic such as high-density polyethylene (HDPE). Different grades of plastic, such as HDPE, are used in different embodiments to give different physical properties and/or weather capability. Certain grades of plastic are very stiff, others are rubbery, allowing tuning of the structure's performance to match the climate where it is deployed. For example, UHMPE, HDPE, cross-linked polyethylene (PEX), medium density polyethylene (MDEP), linear low density polyester (LLDPE) low density polyethylene (LDPE), very low density polyethylene (VLDPE) may be used based on their physical or chemical properties. UHMWPE is polyethylene with a molecular weight numbering in the millions, usually between 3.1 and 5.67 million, and is a very tough material. HDPE is defined by a density of greater or equal to 0.941 g/cm$^3$. HDPE has a low degree of branching and thus stronger intermolecular forces and tensile strength. PEX is a medium- to high-density polyethylene containing cross-link bonds introduced into the polymer structure. The high-temperature properties of the polymer are improved, its flow is reduced and its chemical resistance is enhanced. MDPE is defined by a density range of 0.926-0.940 g/cm$^3$, and has good shock and drop resistance properties. It also is less notch sensitive than HDPE, stress cracking resistance is better than HDPE. LLDPE is defined by a density range of 0.915-0.925 g/cm$^3$, has higher tensile strength than LDPE and exhibits higher impact and puncture resistance than LDPE. LDPE is defined by a density range of 0.910-0.940 g/cm$^3$, and has a lower tensile strength and increased ductility. VLDPE is defined by a density range of 0.880-0.915 g/cm$^3$, and is a substantially linear polymer with high levels of short-chain branches, commonly made by copolymerization of ethylene with short-chain alpha-olefins.

Stay Cable

Figure 6:
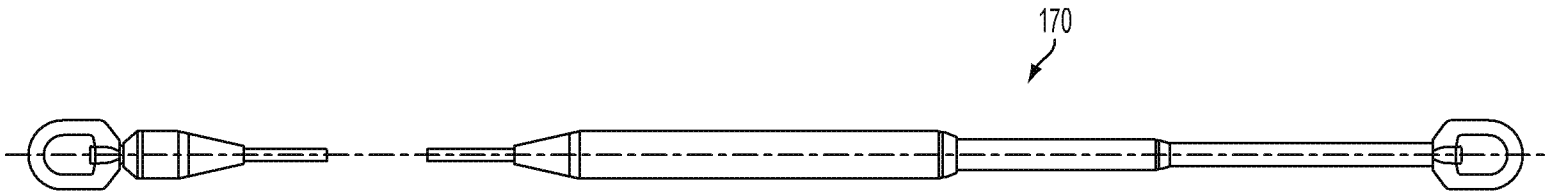
FIG. 6 shows an exemplary view of a cable in accordance with one example of the present disclosure.
Figure 7A:
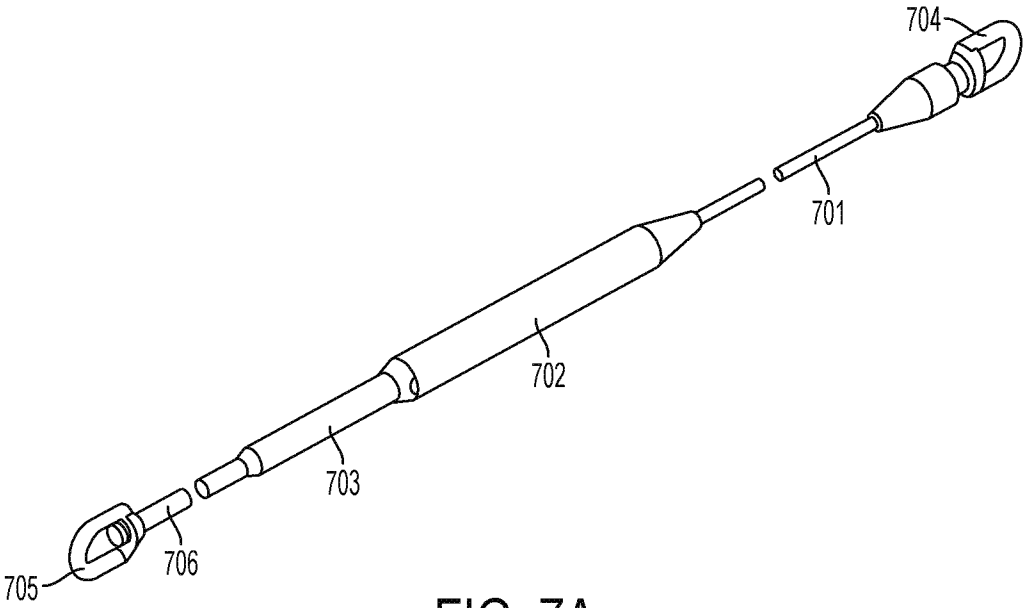
FIG. 7A shows another exemplary view of a cable.
Figure 7B:
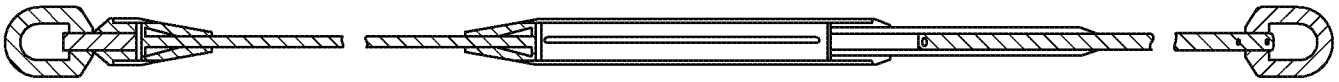
FIG. 7B shows an exemplary cross sectional view of the cable of FIG. 7A.
Figure 8:
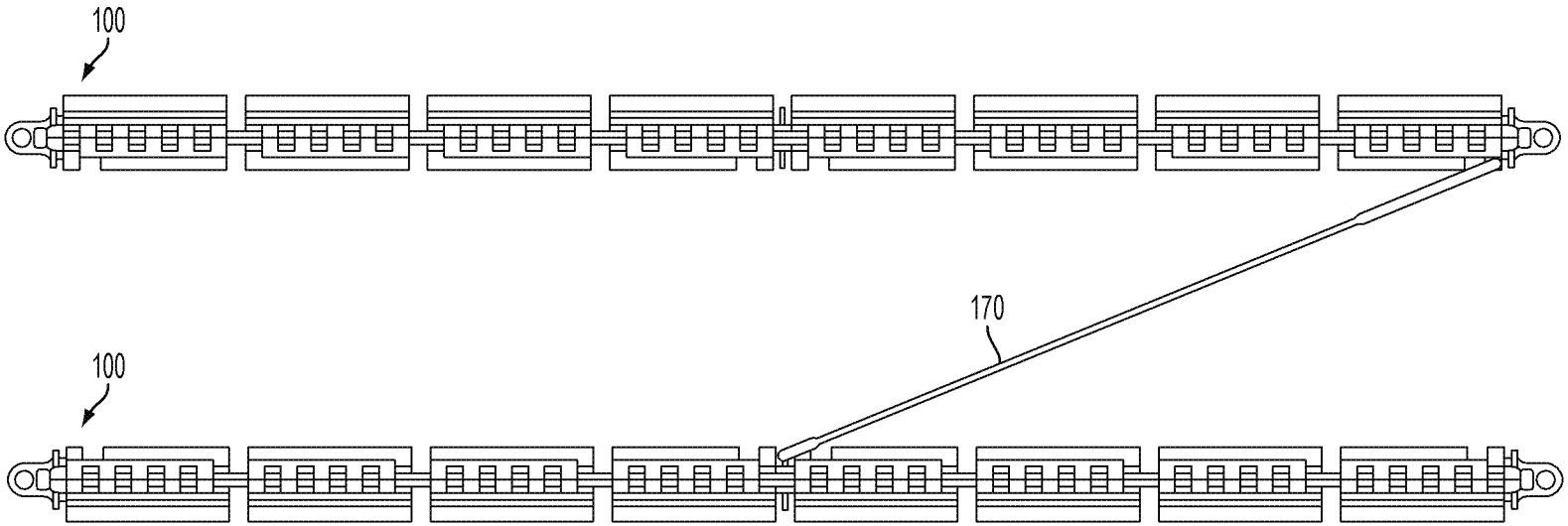
FIG. 8 shows an exemplary view of a security barrier gate with a cable in accordance with one example of the present disclosure.

Stay cables 170 are provided to limit motion between two panel groups 100, and also provide a similar function to trusses. Examples of stay cables are shown in FIGS. 6 and 7A-7B. The stay cable includes a cable core 701, for example, a steel wire cable or a synthetic cable, outer tube 702 attached to one end of the cable core 701, and inner tube 703. The inner tube 703 threads into the outer tube 702 so that the length and tension of the stay cable 170 can be adjusted. The other end of the cable core 701 is attached to a forged eye bolt 704. Another forged eye bolt 705 is attached to the inner tube 703 via a threaded rod 706. The stay cables 170 are attached between the panel groups as shown in FIGS. 1 and 8.

The type of cables used results in a specific stiffness, which in turn affects the motion of the structure. Steel cables have the least amount of stretch, while synthetic cables have a wide range of stretch characteristics. The choice of cable type enables the user to tune the structure for the environment in which it is to be deployed, from high energy ocean environments to placid rivers.

Reinforcing Strap

Figure 9:
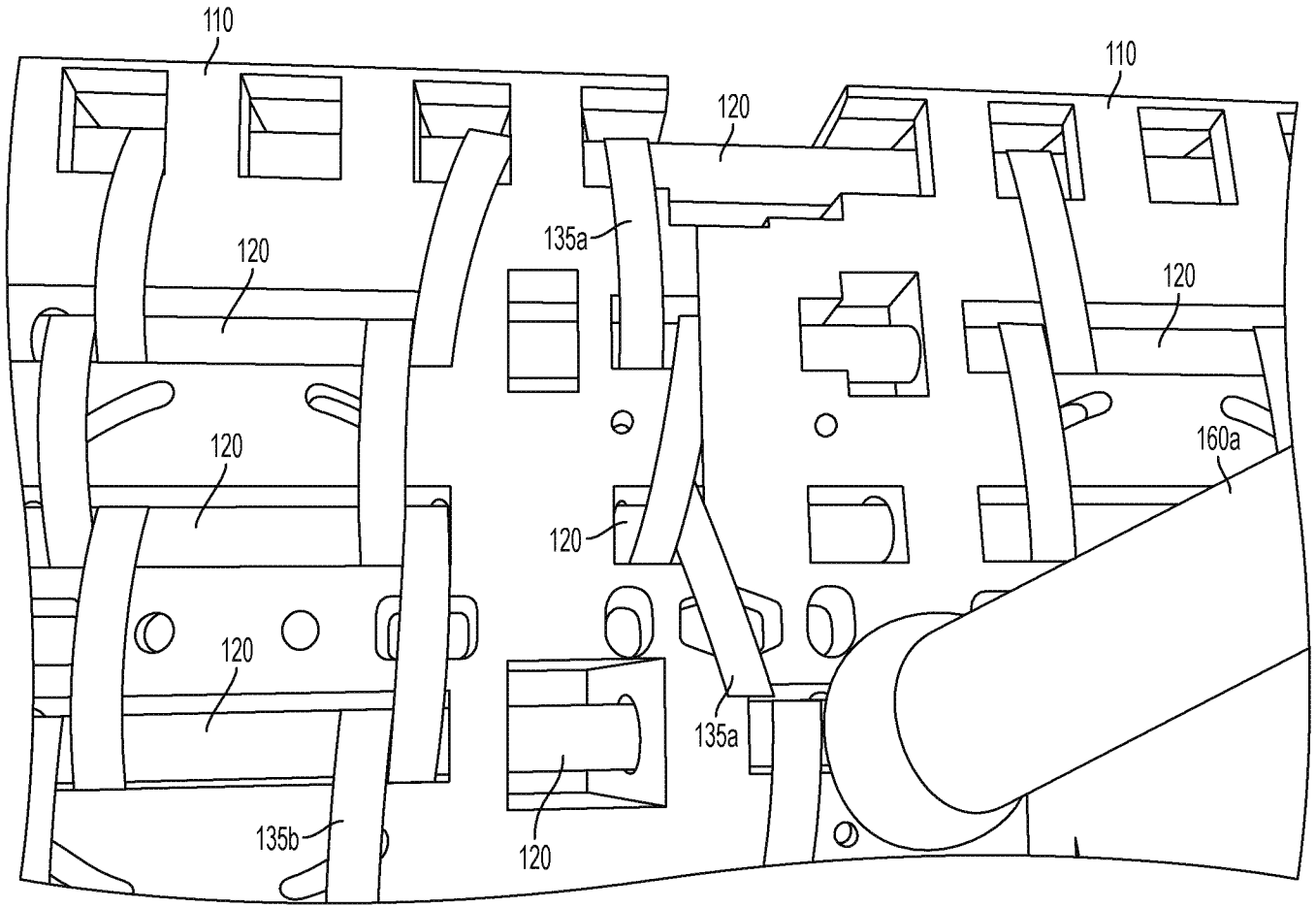
FIG. 9 shows an exemplary view of an application of straps in accordance with one example of the present disclosure.

The security barrier system may further include reinforcing straps 135 as shown in FIGS. 3 and 9. The reinforcing strap 135 is made of, for example, polyester webbing. Spectra® or Dyneema® may be used. The reinforcing straps are wrapped around and between the tubes 120 to limit motion and to prevent spreading of the tubes 120 during an impact. The reinforcing strap 135 can be provided between barrier panels 110 (across the barrier panels) (see, 135*a* of FIG. 9) and/or within a barrier panel 110 (see, 135*b* of FIG. 9). The strap 135 may be made of nylon or rubber.

Intermediate Members

Figures 10A, 10B, 10C, 10D, 10E, 10F, 10G, 10H:
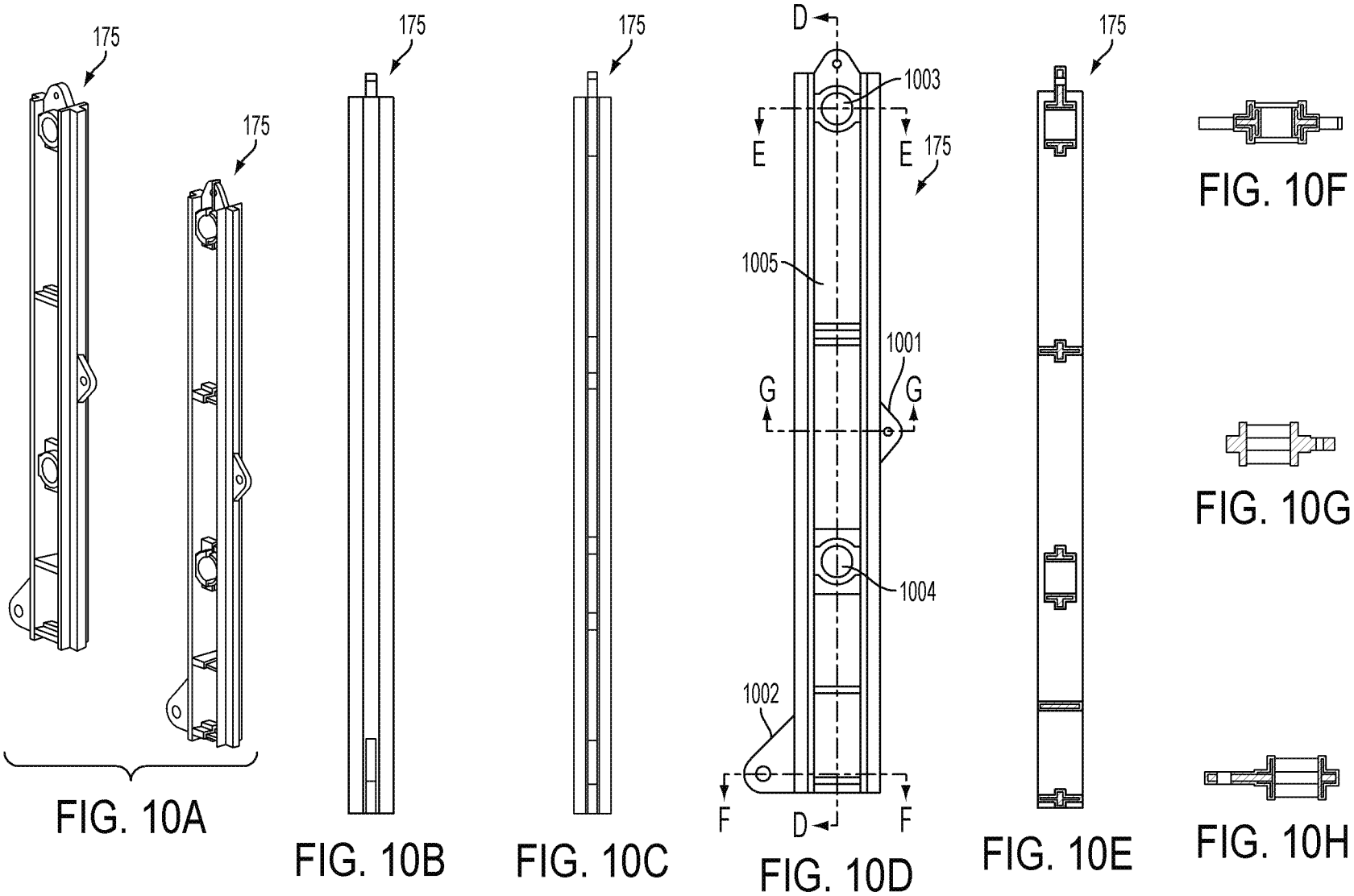
FIG. 10A shows an exemplary perspective view of a midpoint mooring member in accordance with one example of the present disclosure.
FIG. 10B is a side view of the midpoint mooring member of FIG. 10A.
FIG. 10C is another side view of the midpoint mooring member of FIG. 10A.
FIG. 10D is a front view of the midpoint mooring member of FIG. 10A.
FIGS. 10E-10H are cross sectional view of the lines D-D, E-E, G-G and F-F of FIG. 10D, respectively.

Intermediate members include transfer beam 130 and midpoint mooring member 175 as shown in FIGS.10A-10C and are disposed between the barrier panels 110. The transfer beam 130 has holes or openings so that the rope tubes 120 pass through. The transfer beam 130 can be integrated with the barrier panel 110 in an un-detachable manner.

Figure 11:
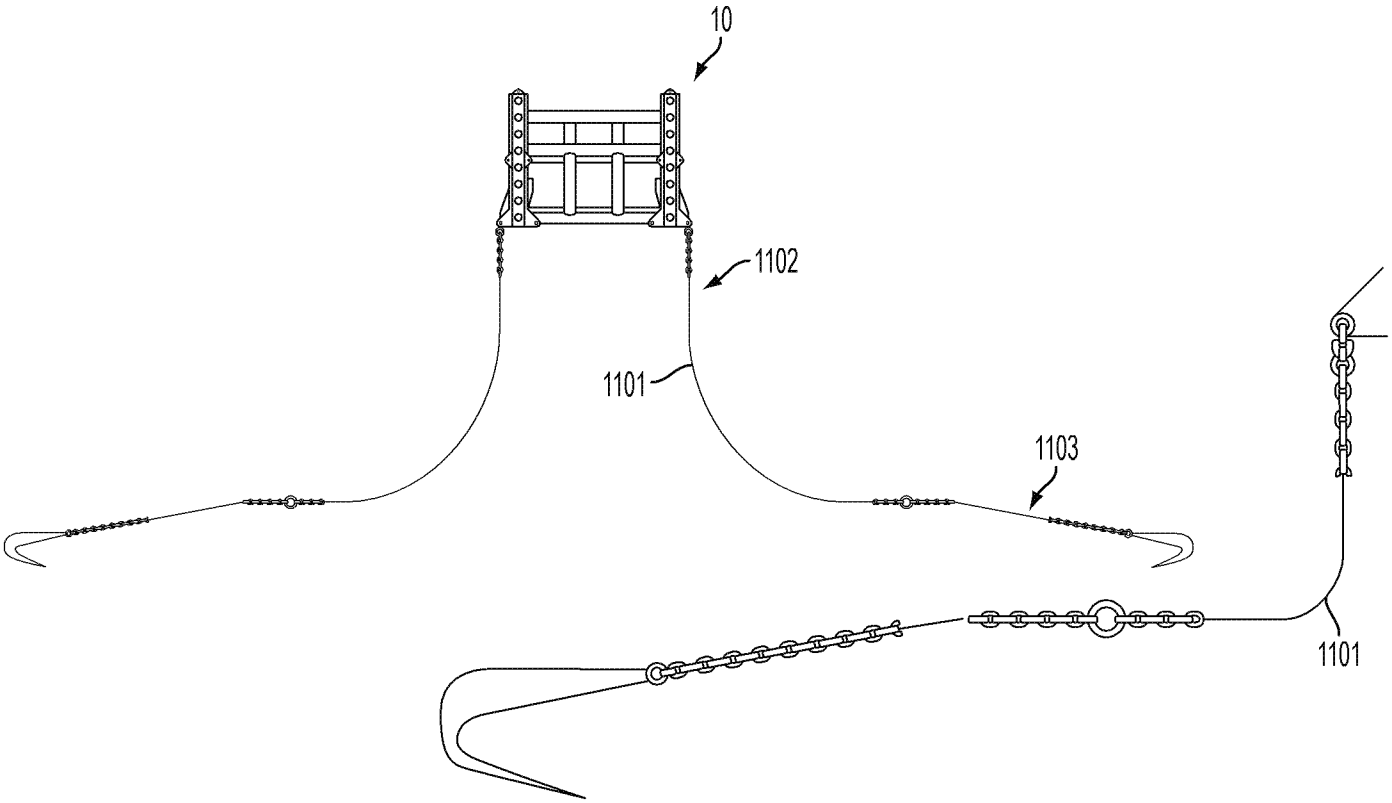
FIG. 11 shows an exemplary view of application of an anchor cable to a security barrier gate in accordance with one example of the present disclosure.

A midpoint mooring member 175 is provided at the center of sub-panel group 100 between the center barrier panels 110. The midpoint mooring member 175 includes a mid anchor plate 1001 and a bottom anchor plate 1002 for attaching an anchor system to the barrier panel 10. The midpoint mooring member 175 also has holes 1003, 1004 and openings 1005 so that the rope tubes 120 pass through. The midpoint mooring member 175 includes a steel core covered with a plastic, for example, polyurethane, for providing weather and wear resistance. The security barrier system may be anchored to the sea bed through anchor chain 1101 attached to the anchor plates 1001 and/or 1002, as shown in FIG. 11. The anchor chain 1101 may include a raiser chain 1102 and a ground chain 1103. The midpoint mooring member 175 can be integrated with the barrier panel in an un-detachable manner.

End Member

End members 140 as shown in FIGS. 1A-3D and 12 are attached to the ends of sub-panel groups 100 and connect the adjacent sub-panel groups 100 with each other. The end member 140 has holes or openings to accommodate the rope tubes 120. The rope tubes 120 are attached to the end member by an anchor nut 150 threading onto the end of rope tubes 120. In this way, a plurality of barrier panels 110 (e.g., 8 barrier panels) together with the intermediate members are securely connected by the rope tubes 120 and the end members 140, thereby forming a sub-panel group 100.

The end member 140 can further include one or more anchor plates 1201 for attaching an anchor system to the barrier panel 10. The end member 140 can include a steel core covered with a plastic, for example, polyurethane, for providing weather and wear resistance.

Figure 12:
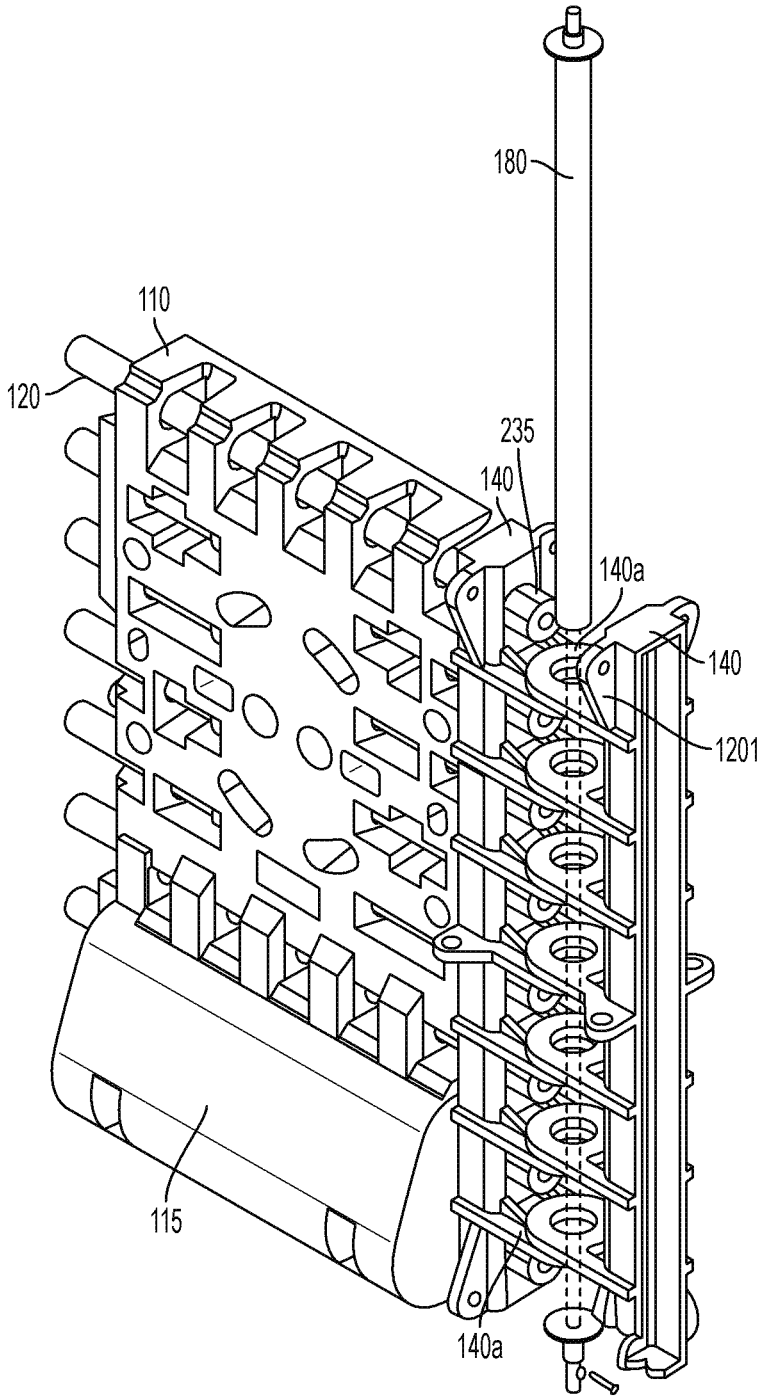
FIG. 12 shows an exemplary view of an end member connecting security barrier panel groups in accordance with one example of the present disclosure.

The end member 140 has a plurality of lugs 140*a* protruding perpendicular from the body of the end member. Each of the lugs 140*a* includes a through-hole to accept a vertical connector pin 180. To connect the sub-panel groups 100 (e.g., first and second sub-panel groups), the lugs 140*a* of two adjacent end members 140 are aligned so that the connector pin 180 is passed through the lugs 140*a* of the two end members 140, as shown in FIG. 12. Of course, three or more sub-panel groups can be connected to obtain a desired distance of a barrier panel group. The lugs 140*a* may be disposed between the connecting points of the rope tubes.

Connector Pin

Figure 13A:
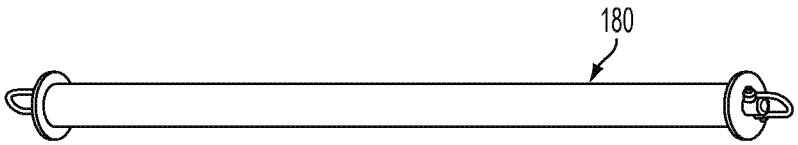
FIG. 13A shows an exemplary perspective view of a connector pin in accordance with one example of the present disclosure.
Figure 13B:
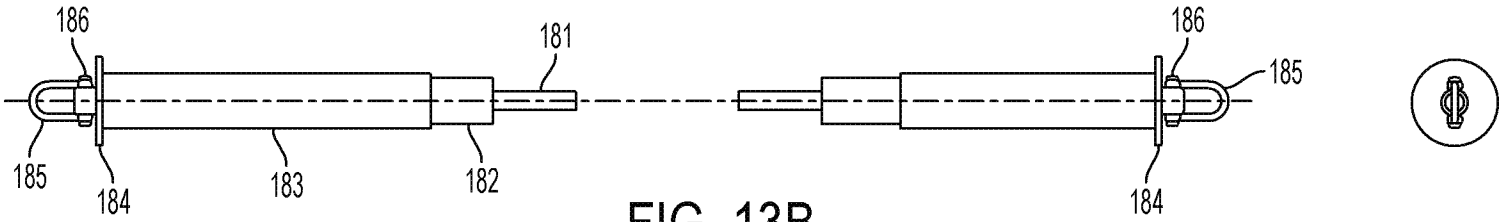
FIG. 13B shows a detailed view of the connector pin of FIG. 13A.
Figure 13C:
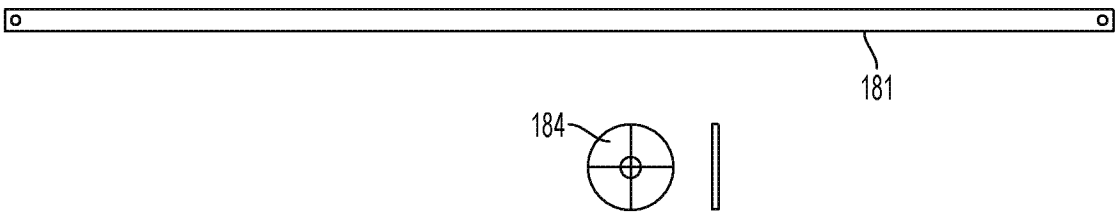
FIG. 13C shows an exemplary view of a core rod of the connector pin of FIG. 13A.

A connector pin 180 connects two adjacent sub-panel groups. An exemplary connector pin 180 is shown in FIGS. 13A-13C. The connector pin 180 may includes a core rod 181 made of, for example, steel, surrounded by a molded plastic core 182 made of, for example, polyurethane or rubber, and an outer tube 183 made of, for example, HDPE. The connector pin 180 may be flexible so as to absorb impact on the security barrier while the core rod is sufficiently strong to prevent the barrier panels 110 from disengaging. End plates 184 are provided at the ends of the connector pin 180, and shackles 185 are further disposed at the ends of the connector pin 180. The shackles are attached to the connector pin by bolts 186.

To connect the sub-panel groups 100, as shown in FIG. 12, the end plate 184 and shackle 185 are assembled to the top end of the connector pin 180. The lugs 140*a* of two end members 140 are aligned, and the connector pin 180 is lowered through the lugs 140. The bottom end plate 184 and shackle 185 are assembled to the connector pin 180. Since the connector pin 180 is movable through the lugs 140*a*, two sub-panel groups are "hinged" so as to absorb an impact on the security barrier system.

Rope Tube and Rope

Figure 14A:
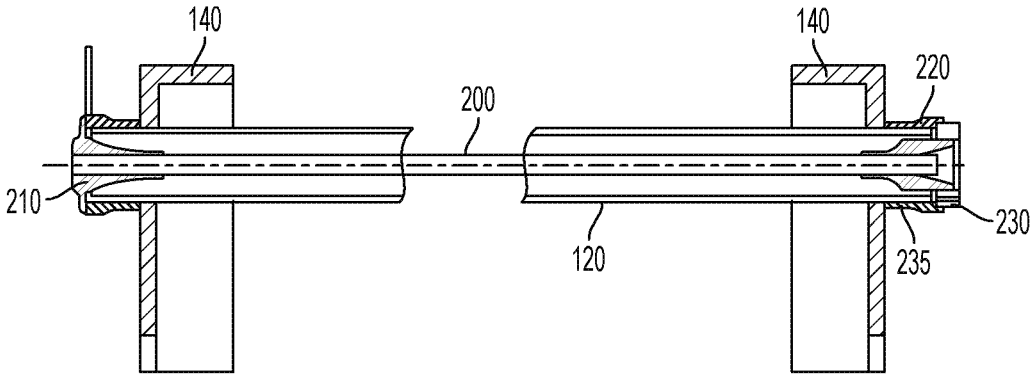
FIGS. 14A and 14B show exemplary cross sectional views of a rope tube and a rope in accordance with one example of the present disclosure.
Figure 16:
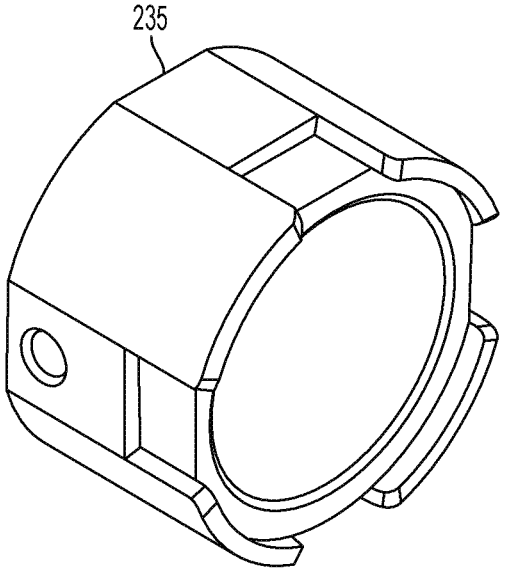
FIG. 16 shows an exemplary view of an anchor nut in accordance with one example of the present disclosure.

FIGS. 14A-20B show examples of the rope tube 120 and rope 200. The ropes 200 are inserted in some of or all of the rope tubes 120. The rope tube 120 is attachable to the end member 140 as shown in FIG. 14A. The rope tube 120 extends through the plurality of barrier panels 110, the intermediate members 130 and 175 and the end members 140, and extends through a hole disposed in the end member 140. Then, an anchor nut 235, as shown in FIG. 16, is threaded onto threads provided at the end of the rope tube. In this way, the plurality of barrier panels 110, the intermediate members 130 and 175 and the end members 140 are tied together by threading the anchor nut 235. The tightness can be adjusted by the amount of thread of the anchor nut 235. The rope tubes 120 may be made of, for example, HDPE, glass-reinforced plastic (GRP), reinforced plastic including Soluforce®, or polycarbonate including Delrin®. The anchor nut 235 may be made of, for example, polycarbonate including Delrin®.

The ends of the ropes 200 can be terminated in several different ways. In one example, one end of the rope 200 is fixedly attached to the end of the rope tube 120, while the other end of the rope 200 is adjustably attached to the other end of the rope tube 120, for example, by using a washer nut and a thread, so that the length and tension of the ropes in the rope tube can be adjusted. The ropes 200 may be made of, for example, polyester, Spectra® or Dyneema®, depending on the desired elongation characteristics.

Figure 14B:
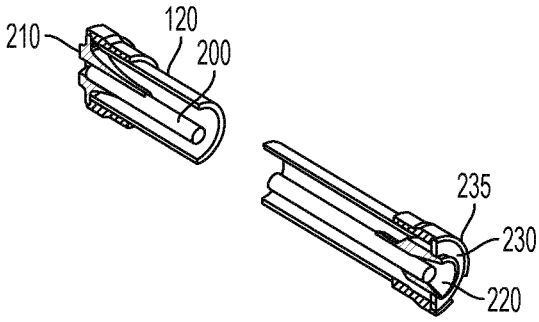
Figure 15:
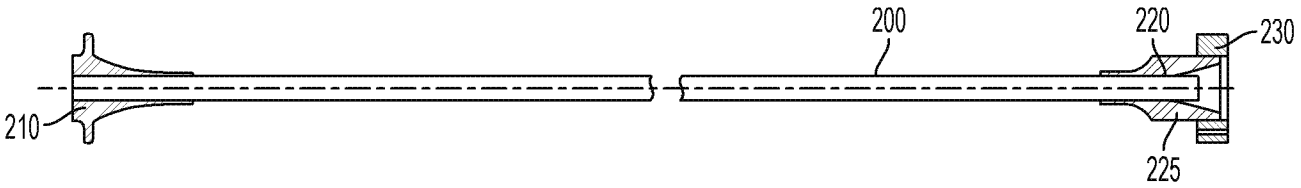
FIG. 15 shows an exemplary cross sectional view of the rope of FIGS. 14A and 14B.
Figure 17:
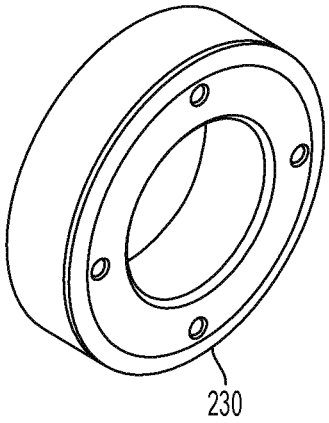
FIG. 17 shows an exemplary view of a washer nut in accordance with one example of the present disclosure.

As shown in FIGS. 14A and 14B, a steel end 210 and an anchor extension 220 made of, for example, stainless steel or plastic, are attached to the ends of rope 200. Threads are provided at the end of the anchor extension 220. A washer nut 230, as shown in FIG. 17, threads onto the threaded end of the anchor extension 220. The steel end 210 is used for the fixed end of the rope and is attached to the end of rope tube, and may not have thread for accepting the washer nut. The washer nut is made of, for example, metal such as aluminum.

In a certain configuration, a resin can be poured into a space between the rope and the steel end and/or the anchor extension. The resin hardens and traps the end of the rope, and the individual fibers of the rope are encapsulated in the resin.

Figure 18:
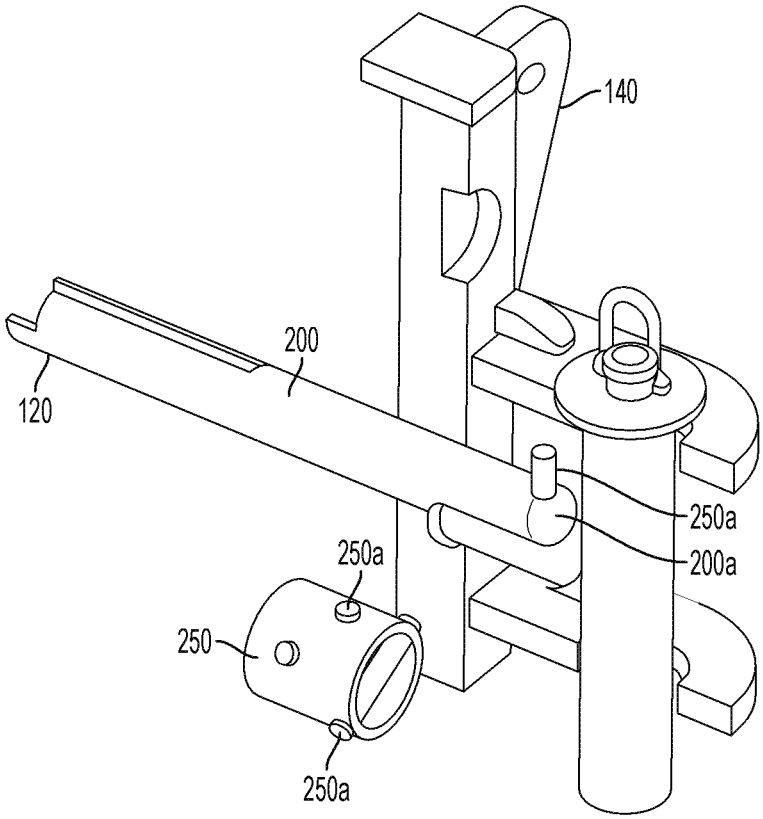
FIG. 18 shows an exemplary view of a fixed connection of a rope in accordance with one example of the present disclosure.
Figure 19:
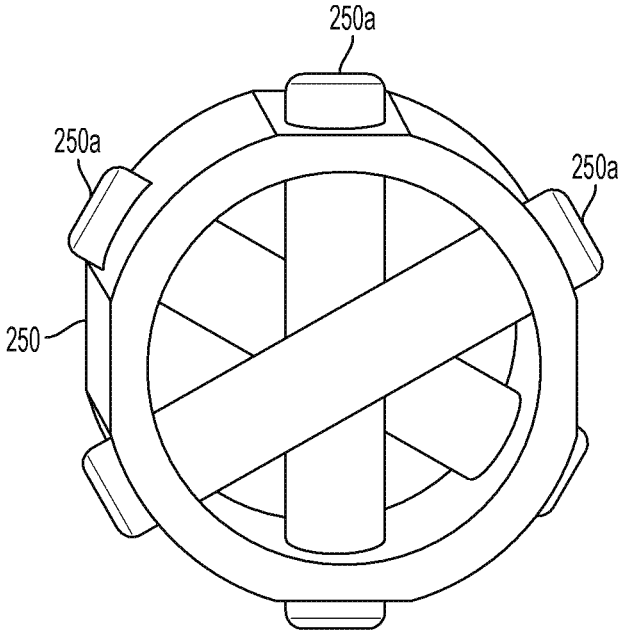
FIG. 19 shows an exemplary view of a rope retainer in accordance with one example of the present disclosure.

As shown in FIGS. 18 and 19, in other embodiments, the ropes 200 may be terminated with a rope eye 200*a*. A rope retainer 250 is attached to the rope eye 200*a* with a cross tie or pin 250*a* after the rope 200 is passed through the hole of the end member 140 to retain the end of rope 200 in the end member 140. For example, the ropes 200 have a loop or an eye at their ends. The pins 250*a* in the cross tie pass through the nuts on the ends of the rope tubes 120 containing the rope 200 and pass through the eyes of the rope 200 retaining its position. The pin 250*a* is larger than the hole in the end member 140 and bears against it when rope is pulled taught during impact.

Figure 20A:
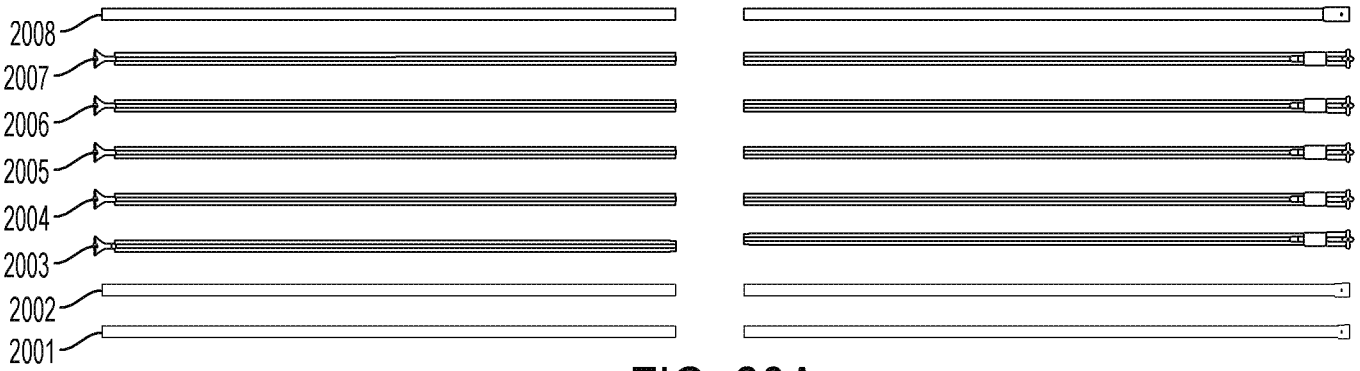
FIGS. 20A and 20B show an exemplary view of plural rope tubes.
Figure 20B:
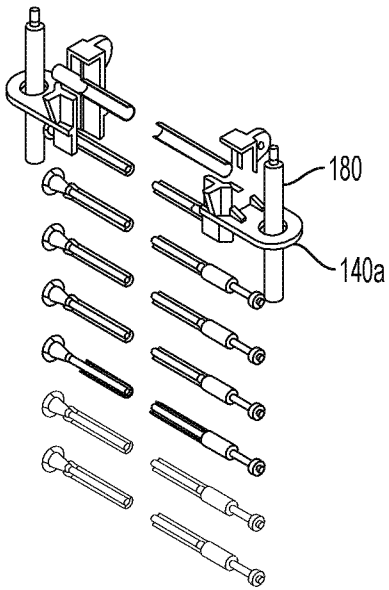
Figure 21A:
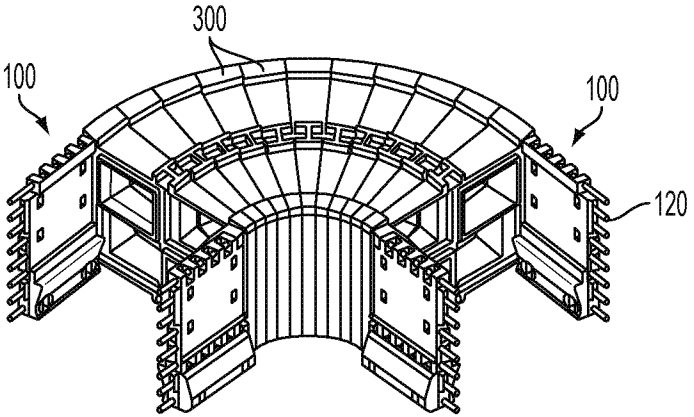
FIG. 21A shows an exemplary perspective view of wedge-shaped buoys in accordance with one example of the present disclosure.
Figure 21B:
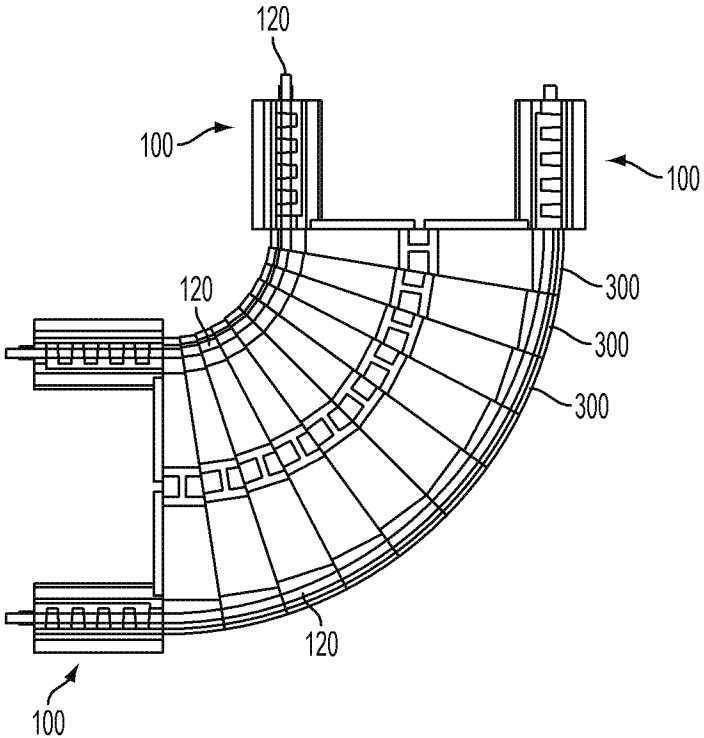
FIG. 21B shows an exemplary top view of the wedge-shaped buoys of FIG. 21A.
Figure 21C:
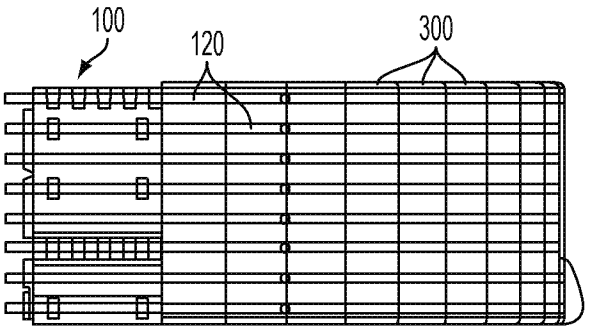
FIG. 21C shows an exemplary side view of the wedge-shaped buoys of FIG. 21A.
Figure 22A:
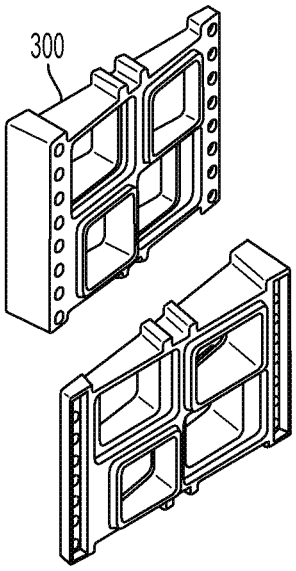
FIG. 22A shows an exemplary perspective view of an application of wedge-shaped buoy.
Figure 22B:
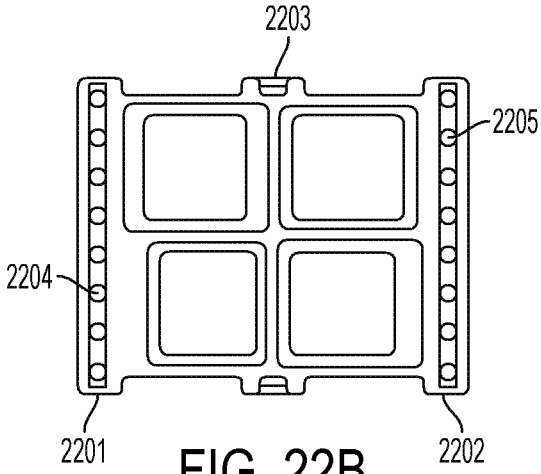
FIG. 22B shows a front view of the wedge-shaped buoy of FIG. 22A.
Figure 22C:
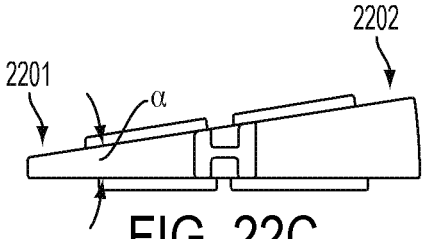
FIG. 22C shows a top view of the wedge-shaped buoy of FIG. 22A.
Figure 22D:
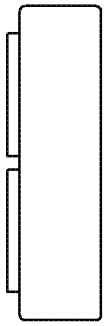
FIG. 22D shows a side view of the wedge-shaped buoy of FIG. 22A.
Figure 22E:
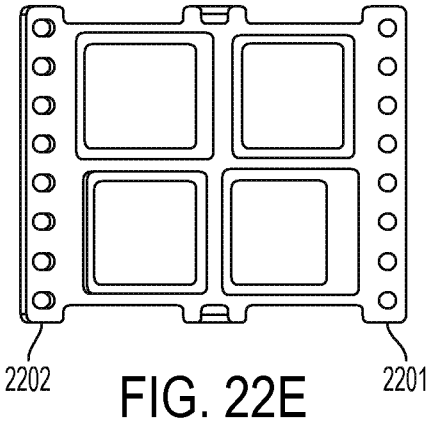
FIG. 22E shows a rear view of the wedge-shaped buoy of FIG. 22A.
Figure 22F:
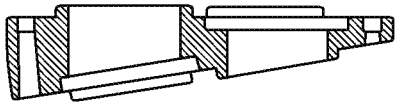
FIGS. 22F and 22G show exemplary cross sectional views of the lines A-A and B-B of FIG. 22E, respectively.
Figure 22G:
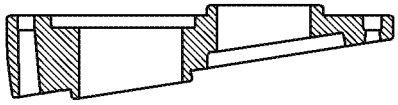
Figure 23B:
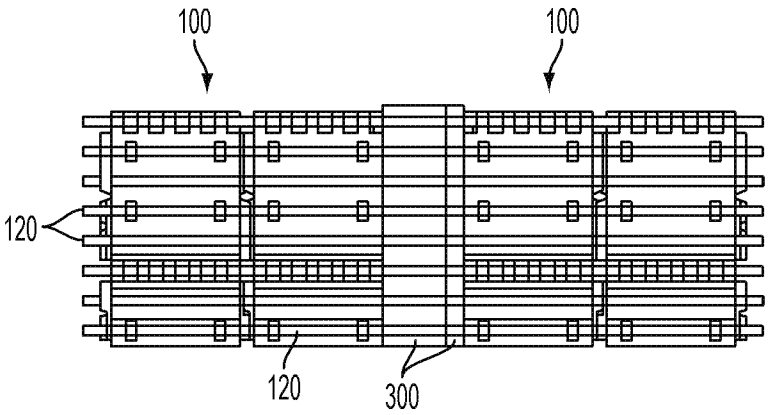
FIG. 23B shows an exemplary front view of the wedge-shaped buoys of FIG. 23A.
Figure 23D:
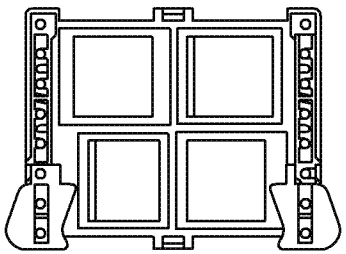
FIG. 23D shows an exemplary side view of the wedge-shaped buoys of FIG. 23A.
Figure 23A:
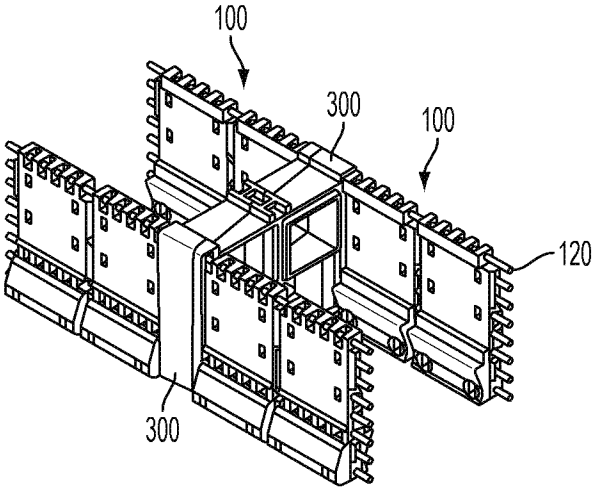
FIG. 23A shows an exemplary perspective view of another application of wedge-shaped buoys in accordance with one example of the present disclosure.
Figure 23C:
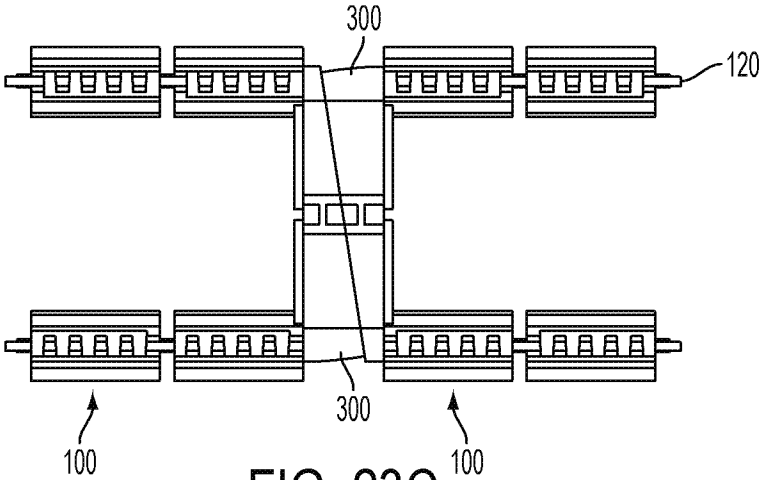
FIG. 23C shows an exemplary top view of the wedge-shaped buoys of FIG. 23A.

As shown in FIGS. 20A-20B, in a certain configuration, the rope tubes 120 in the security barrier system are made of different materials depending on where the rope tubes are installed in the barrier panel. For example, rope tubes 2004-2007 disposed at an impact zone are made of glass-reinforced plastic (GRP), while rope tubes 2001-2003 and 2008 are made of HDPE or reinforced plastic including Soluforce®. In this example of FIGS. 20A and 20B, rope tubes 2001, 2002 and 2008 do not contain ropes. By utilizing tubes having differing physical characteristics, the security barrier system's performance can be customized.

Wedge-Shaped Buoy

The security barrier system may include a wedge-shaped buoy instead of or in addition to the connecting member such as trusses. FIGS. 21A-23D show applications and configurations of the wedge-shaped buoy 300.

The wedge-shaped buoys 300 may be disposed between two panel groups 100 to shape the security barrier system as desired, for example, to conform the shape of the barrier system to a shoreline, an offshore rig, etc. Instead of or in addition to the trusses 160*a*, 160*b* described above, the wedge-shaped buoys 300 span two rows of panel groups 100. The rope tubes 120 pass through the wedge-shaped buoys 300 to enable them to have the impact-resistance of each of the panel groups 100 (see, FIG. 21C).

Each of the wedge-shaped buoys 300 is designed to fit together to form larger pie-shaped segments that connect the adjacent panel groups 100 as well as the rows of the panel groups 100. The wedge-shaped buoys 300 provide both a transition between lengths of the security barrier system, and mooring points for deep water applications.

As shown in FIGS. 22A-22G, each of the wedge-shaped buoys 300 has a wedge-shape, and includes a shorter end portion 2201, a longer end portion 2202 having a longer width than the shorter end portion, and a body 2203 connecting the shorter end portion 2201 and the longer end 2202, thereby forming a substantially wedge shape. Here, the wedge shape does not necessarily mean a perfect wedge-shape, but may include a wedge-like shape as a whole.

The shorter end portion 2201 and the longer end portion 2202 have openings 2204, 2205, respectively, through which the rope tubes 120 pass. Thee openings 2204 of the shorter end portion 2201 may be disposed at the same height as the openings 2205 of the longer end portion 2202, respectively. The wedge-shaped buoy 300 may have an internal cavity.

As shown in FIGS. 21A-21C and 23A-23D, because of the wedge shape, various angles can be created with the wedge-shaped buoys 300 allowing the security barrier system to make much tighter turns than is possible with straight lengths of barrier. The wedge angle $\alpha$ of each of the wedge-shaped buoys is substantially 90°/n (n is an integer) and, for example 9° (n=10). When, $\alpha$=9°, ten wedge-shaped buoys make a 90° turn. The wedge angle $\alpha$ of 90°/n allows manufacturing errors or tolerances which would be understood by one of ordinary skill in the art.

By combining plural numbers of wedge-shaped buoys 300, the security barrier system can closely follow the outline of objects in the water. Intricate sinusoidal shapes are also possible, allowing the security barrier system to be built in complex shapes.

Two wedge-shaped buoys 300 can also be joined alternately, as shown in FIGS. 23A-23D, to form a rectangular connection point between two panel groups 100. In this case, the wedge-shaped buoys functions similar to the midpoint mooring member 175 and/or trusses 160*a*, 160*b*.

The wedge-shaped buoys 300 are made of, for example, molded polyurethane, and may contain a rigid metallic frame embedded in the polyurethane. The wedge-shaped buoys 300 may further include a mooring plate for attaching an anchor system.

A great deal of energy is released from the security barrier system at its ends. Therefore, any connection or transition to shoreline or individual deepwater buoy needs to be quite robust. The wedge-shaped buoys 300 use the rope tubes 120 which pass through adjacent sub-panel groups 100 to tie into the impact system directly, helping to reduce and redirect the energy through the rest of the barrier system and into the mooring lines of the structure. This flexible joint allows the more rigid lengths of barrier system (e.g., panel groups 100) to seamlessly connect.

Stiffness of the wedge-shaped buoys 300 can be adjusted by changing the type and properties of the material that comprises the wedge-shaped buoy 300. The wedge-shaped buoys 300 can have an internal structure or strengthening members added or embedded in them to increase stiffness and load carrying capability. Additionally, the wedge-shaped buoys 300 when connected to each other form several internal cavities which can be used to hold various payloads including sensors and power generation equipment.

Floating Gate

In operation, the rows of two panel groups 10 are placed in the water and are partially submerged, such that when a vehicle (e.g., a boat) impacts the barrier system, the barrier panels 110, rope tubes 120, straps 135 and ropes 200 absorb energy from the impact using the water. Since the ropes 200 and rope tubes 120 are flexible, and the connector pins 180 and the lugs 140*a* of the end member 140 act as hinges, the security barrier system can "give" to absorb energy without individual parts of the barrier becoming damaged (unless they are designed to yield).

One of the examples of the applications of the security barrier system includes a floating gate 410 that slides to allow traffic to pass the security barrier system. Details of the sliding gate are shown in FIGS. 24A-29D.

Figure 24A:
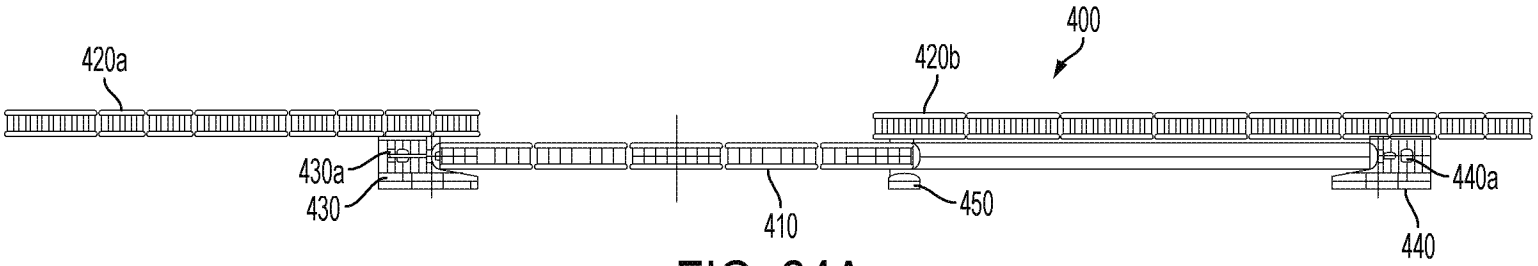
FIG. 24A shows an exemplary top view of a security barrier gate system in accordance with one example of the present application.
Figure 24B:
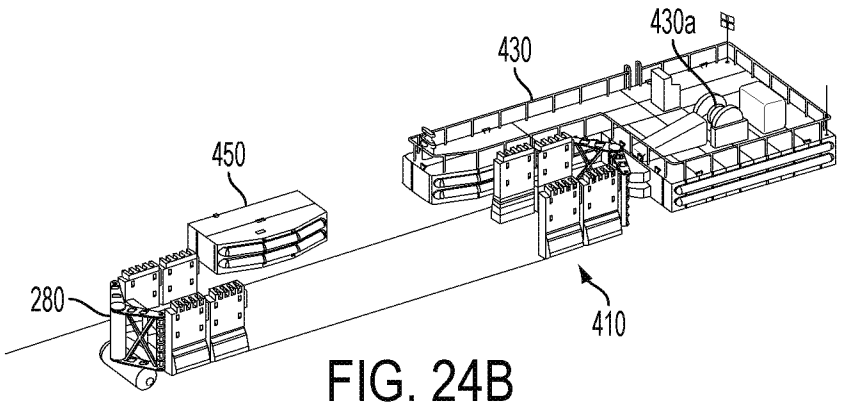
FIG. 24B shows an exemplary perspective view of the security barrier gate system near a docking station.
Figure 24C:
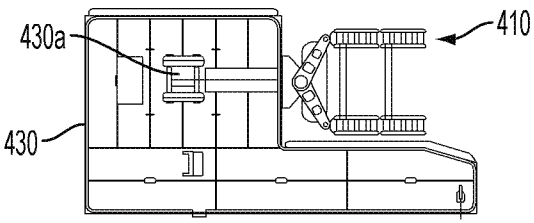
FIG. 24C shows an exemplary top view of the docking station.
Figure 25A:
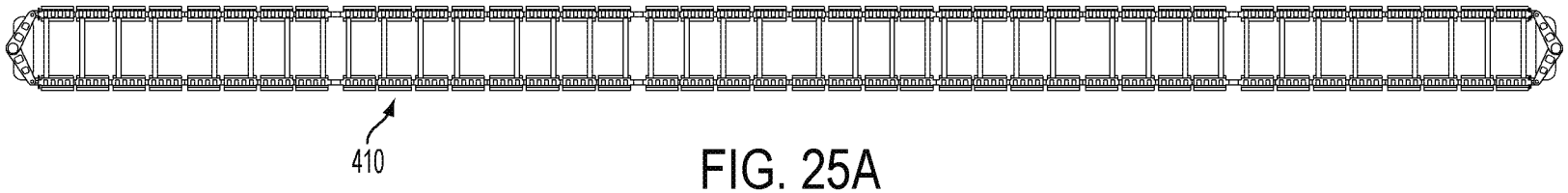
FIG. 25A shows an exemplary top view of a security barrier gate in accordance with one example of the present disclosure.
Figure 25E:
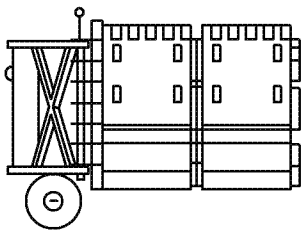
FIG. 25E shows a front view of the end portion of FIG. 25B.
Figure 25D:
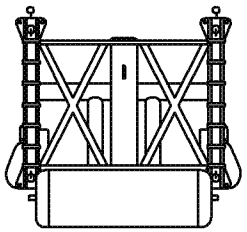
FIG. 25D shows a side view of the end portion of FIG. 25B.
Figure 25C:
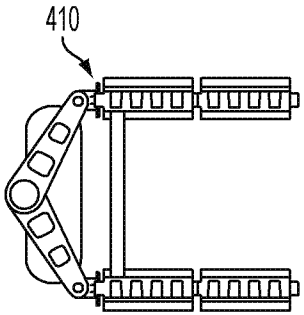
FIG. 25C shows a top view of the end portion of FIG. 25B.
Figure 25B:
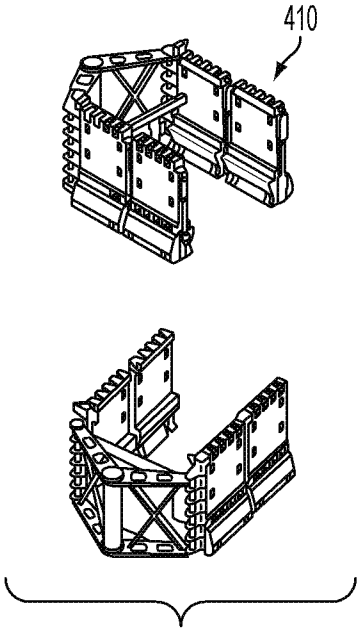
FIG. 25B shows exemplary perspective view of end portion of the security barrier gate of FIG. 25A.
Figure 26A:
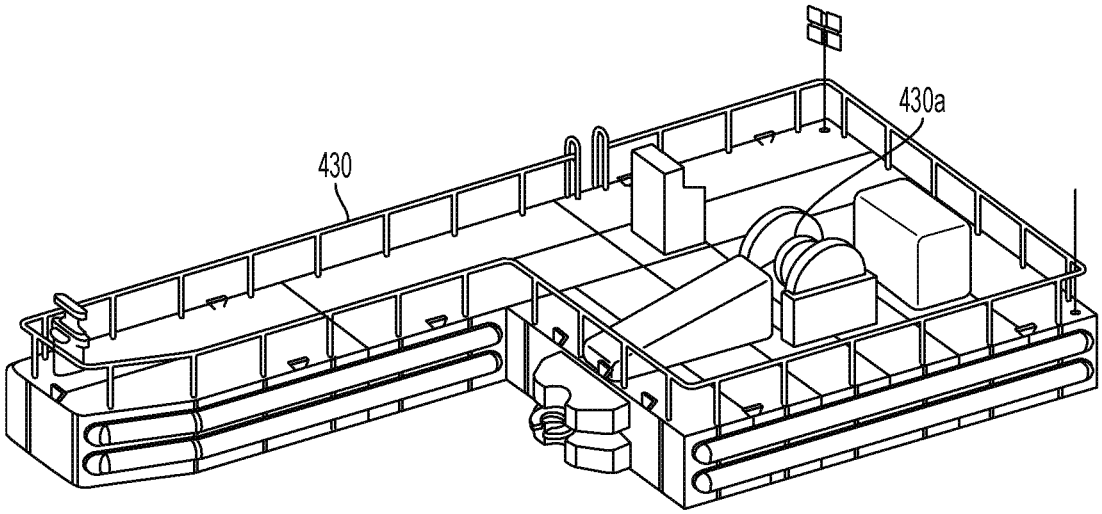
FIGS. 26A and 26B show exemplary perspective views of docking stations in accordance with one example of the present disclosure.
Figure 26B:
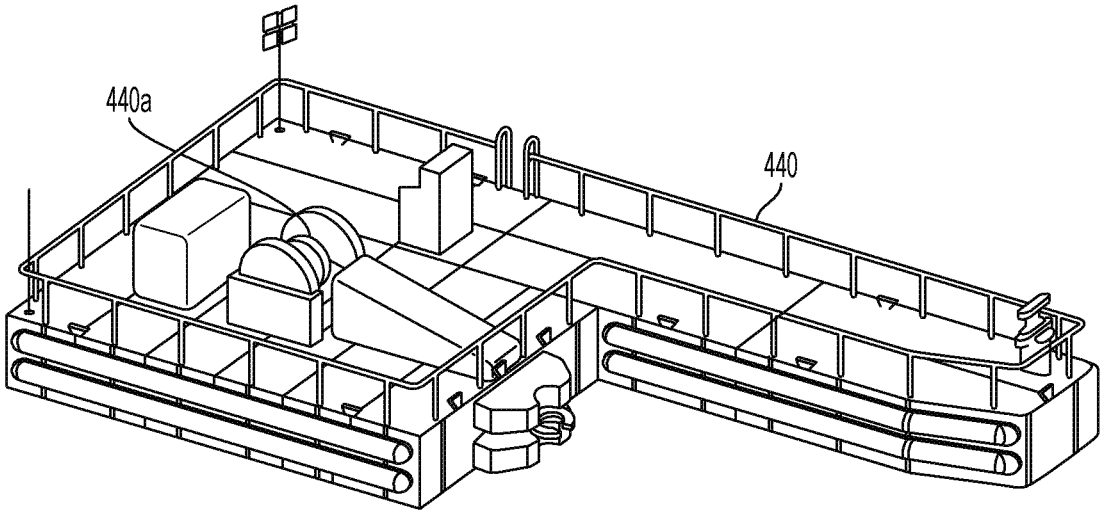
Figure 27:
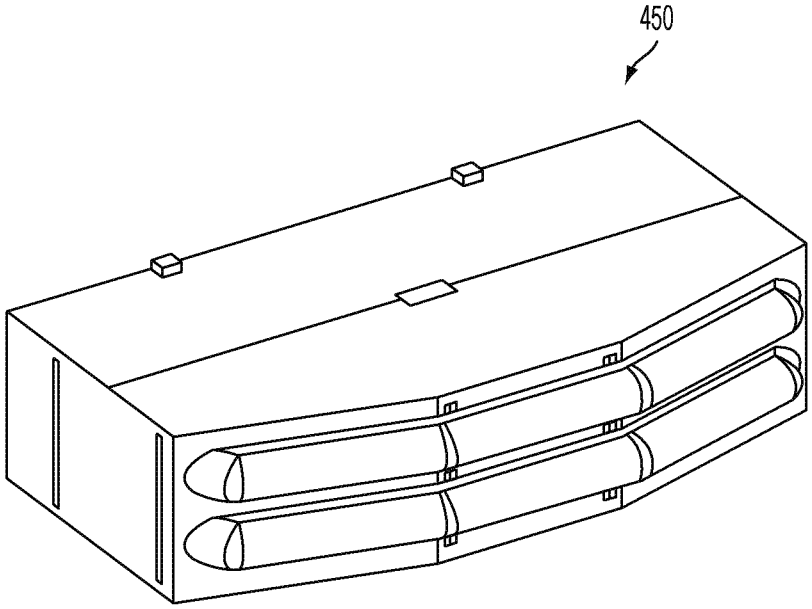
FIG. 27 shows an exemplary perspective view of a guide barge in accordance with one example of the present disclosure.

The floating gate assembly 400 as shown in FIGS. 24A-24C includes a sliding floating gate 410 that is a barrier gate section that includes a row of two panel groups 100 as described above. For example, the row of two panel groups includes two panel groups 100 connected by trusses 160*a*,

160*b* (or wedge-shaped buoys 300), rope tubes 120 and ropes 200 running through the barrier panels. The barrier gate 410 is disposed at a gap between two barrier sections 420*a* and 420*b*, which are fixed constructions.

Figure 28:
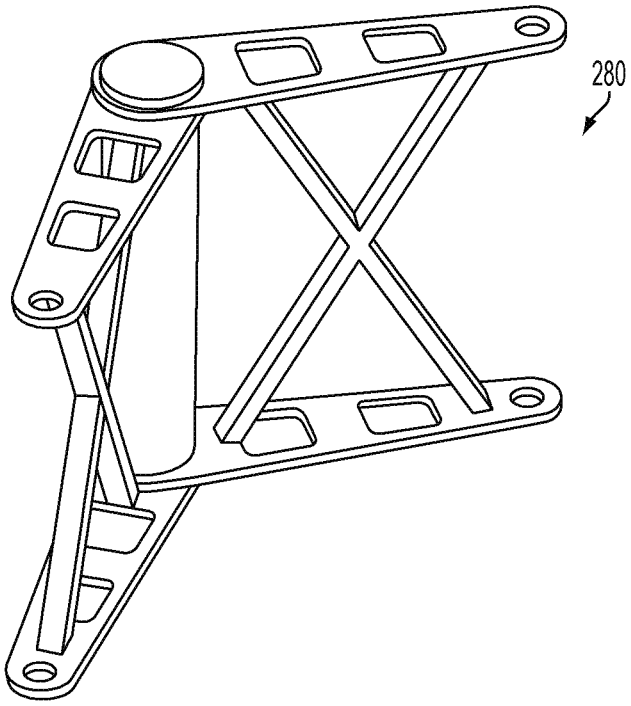
FIG. 28 shows an exemplary perspective view of a bridle in accordance with one example of the present disclosure.
Figure 29A:
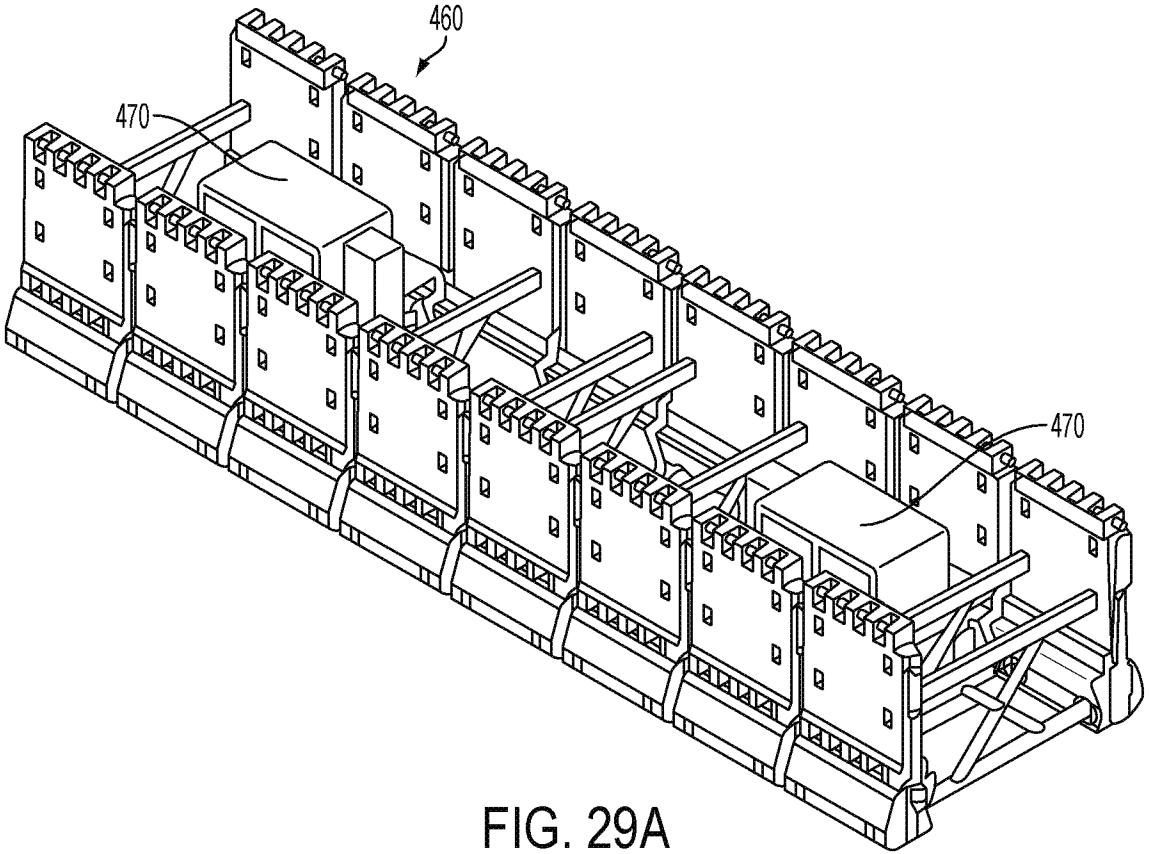
FIG. 29A shows another exemplary perspective view of a security barrier gate in accordance with another example of the present disclosure.
Figure 29B:
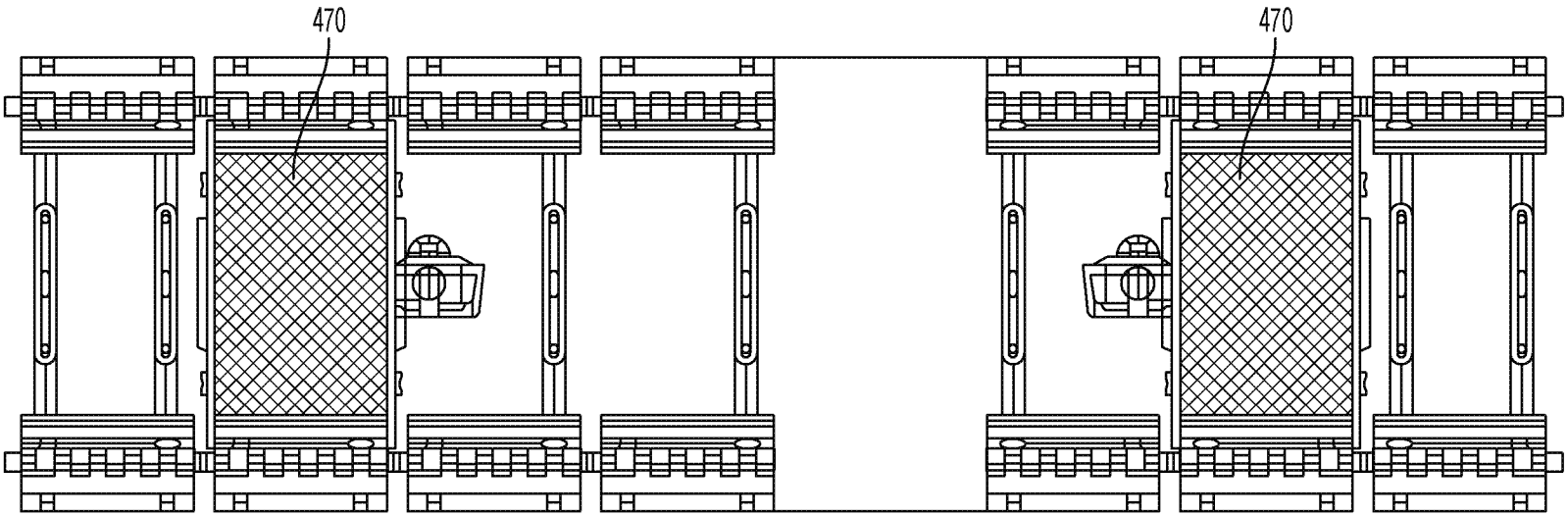
FIG. 29B shows a top view of the security barrier gate of FIG. 29A.
Figure 29C:
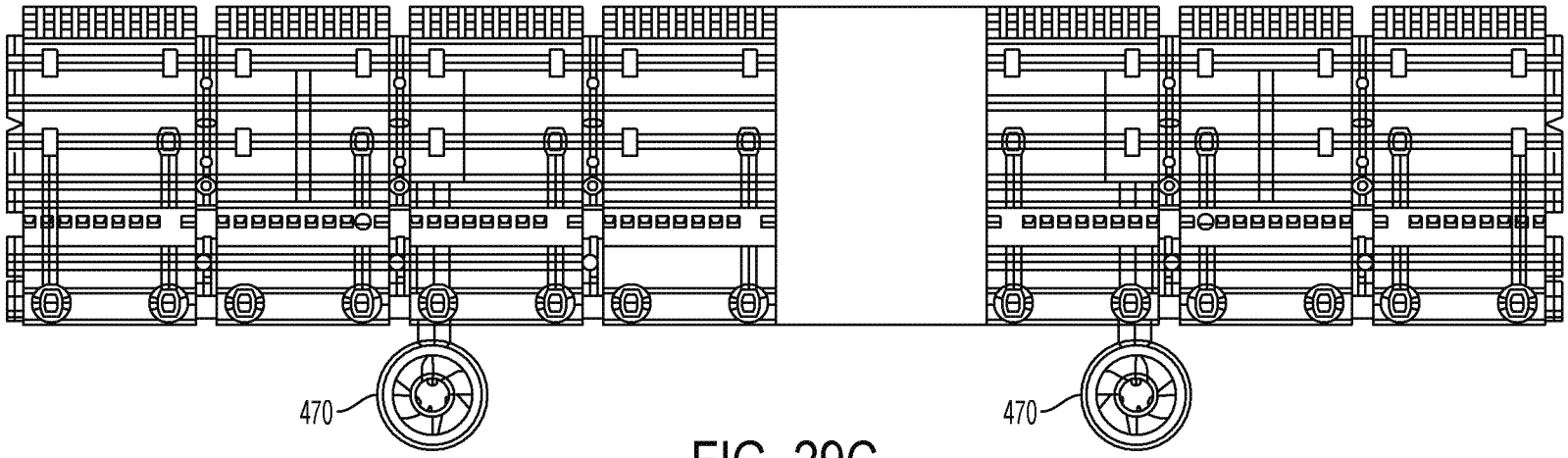
FIG. 29C shows a front view of the security barrier gate of FIG. 29A.
Figure 29D:
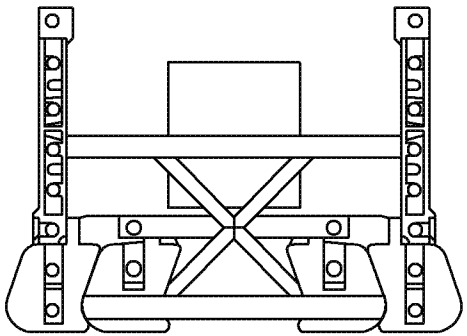
FIG. 29D shows a side view of the security barrier gate of FIG. 29A.

Each of the barrier sections 420*a* and 420*b* includes a docking station 430, 440 attached to the barrier section. Each of the docking stations 430 and 440 has a powered winch 430*a*, 440*a* with a cable attached to a respective end of the gate 410. At the end of the barrier gate 410, a bridle 280 as shown in FIG. 28 is attached, to which the cable is attached.

In operation, to open the security barrier gate 410, the winch 440*a* pulls barrier gate 410 towards the docking station 440 until the barrier gate 410 docks with the docking station 440. The security barrier system may further include a floating center guide barge 450 that guides the barrier gate 410 as it slides through the water. To close the barrier gate 410, the winch 430*a* pulls the barrier gate 410 towards the docking station 430 until it docks with docking station 430. The operation of the security barrier gate system 400 can be automatically controlled by electronic controlling systems. Thus, it is not necessary for an operator to be located at the security barrier gate 410.

In another example, as shown in FIGS. 29A-29D, the floating barrier gate 460 can be self-propelled instead being attached to the barrier. Thrusters 470 may be used to navigate the barrier gate 460 into a desired position. Thrusters 470 are known in the marine industry and are used on barges and marine crafts to facilitate positioning next to berths and through narrow waterways. The thrusters 470 may be provided as a module, and multiple thrusters can be tied together with a common control system to move security barrier in any direction in the water. A thruster is basically a hydraulically controlled propeller that sits in a cowling. The thruster can rotate about an axis to achieve thrust in any direction. When combined with the security barrier system, thrusters allow the security barrier to be moved and positioned precisely without the need for vessel assistance. The control systems can also be pre programmed to perform repetitive motion of the security barrier gate 410 opening and closing.

Figure 30:
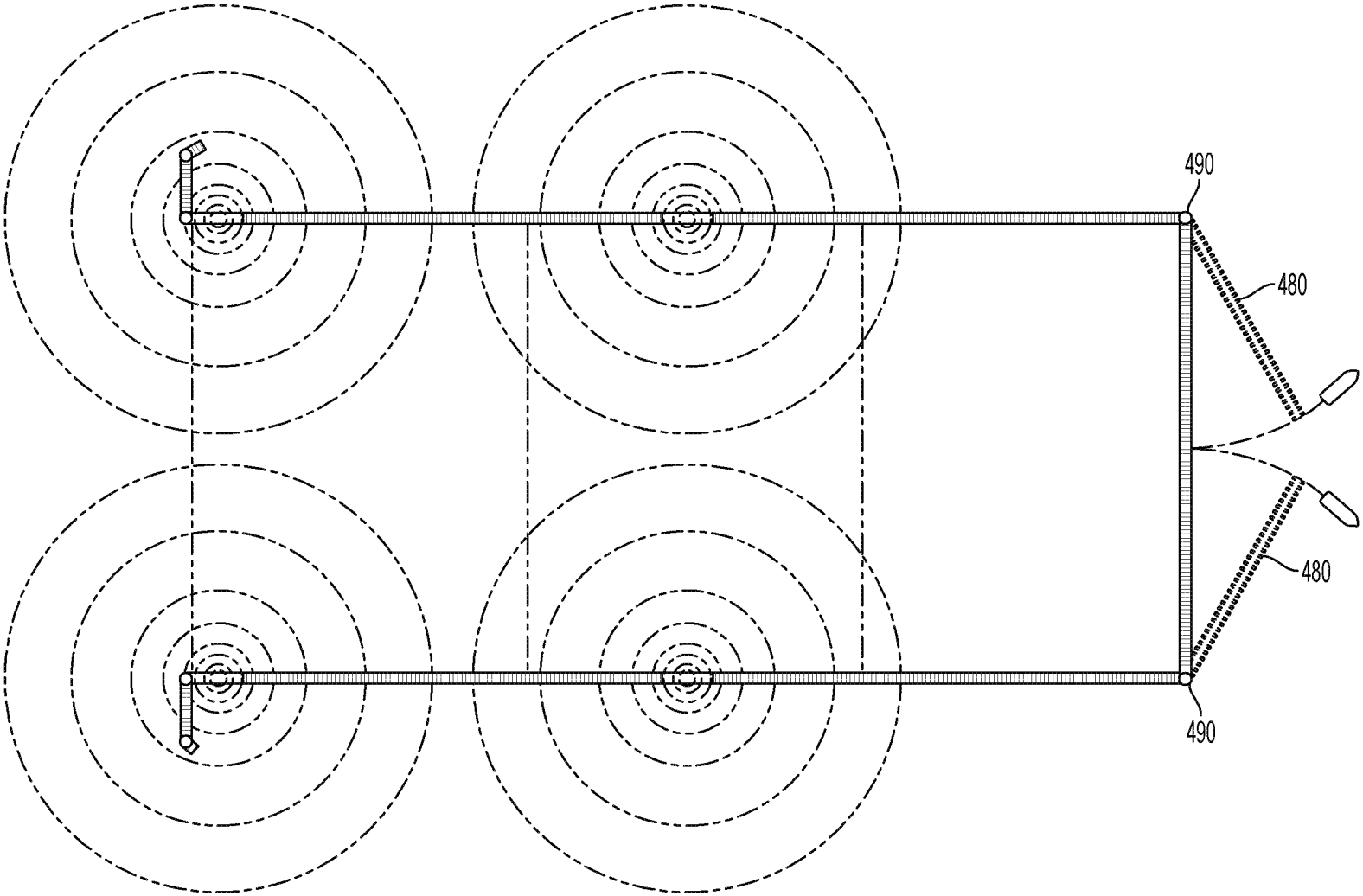
FIG. 30 shows an exemplary top view of another application of a security barrier system in accordance with one example of the present disclosure.
Figure 31A:
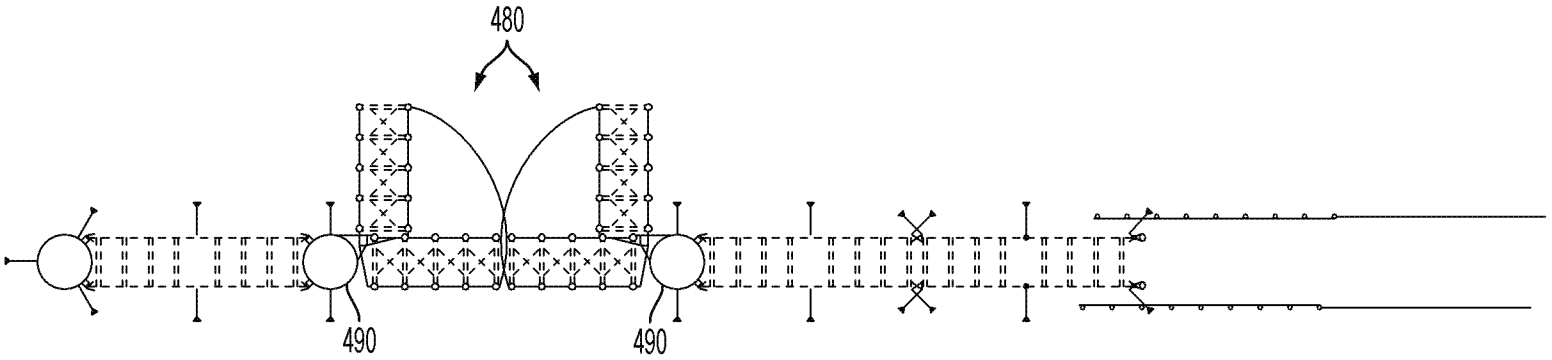
FIG. 31 shows an exemplary view of an application of a security barrier system in accordance with one example of the present disclosure.
Figure 31B:
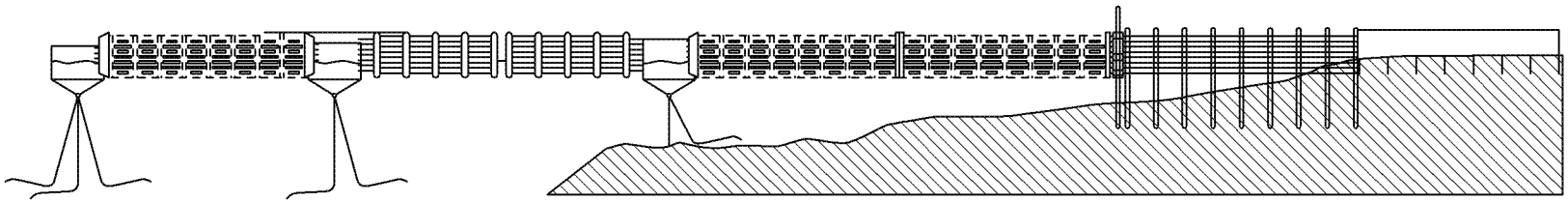
Figure 32A:
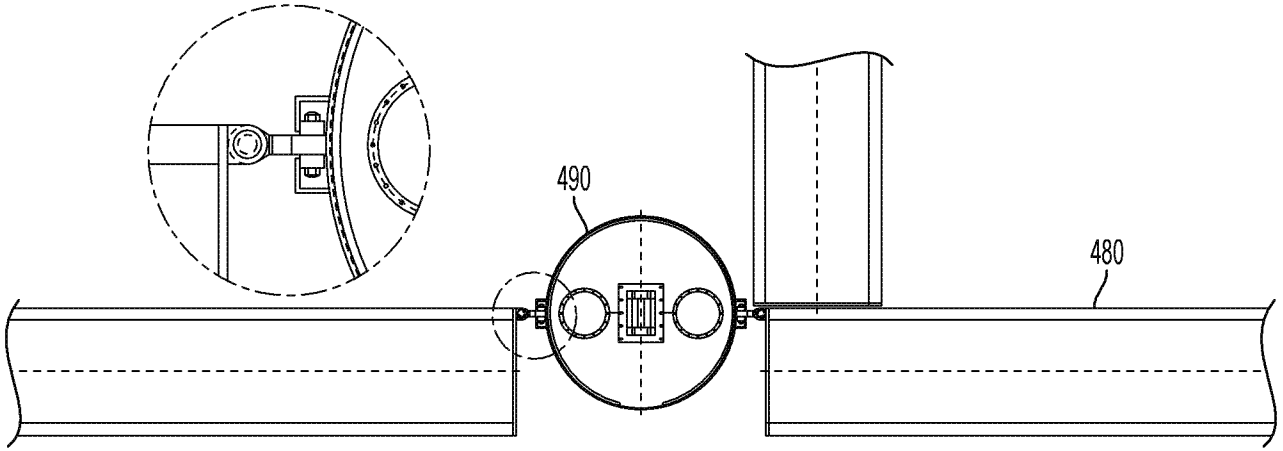
FIG. 32A shows an exemplary top view of a hinge portion of the security barrier system.
Figure 32B:
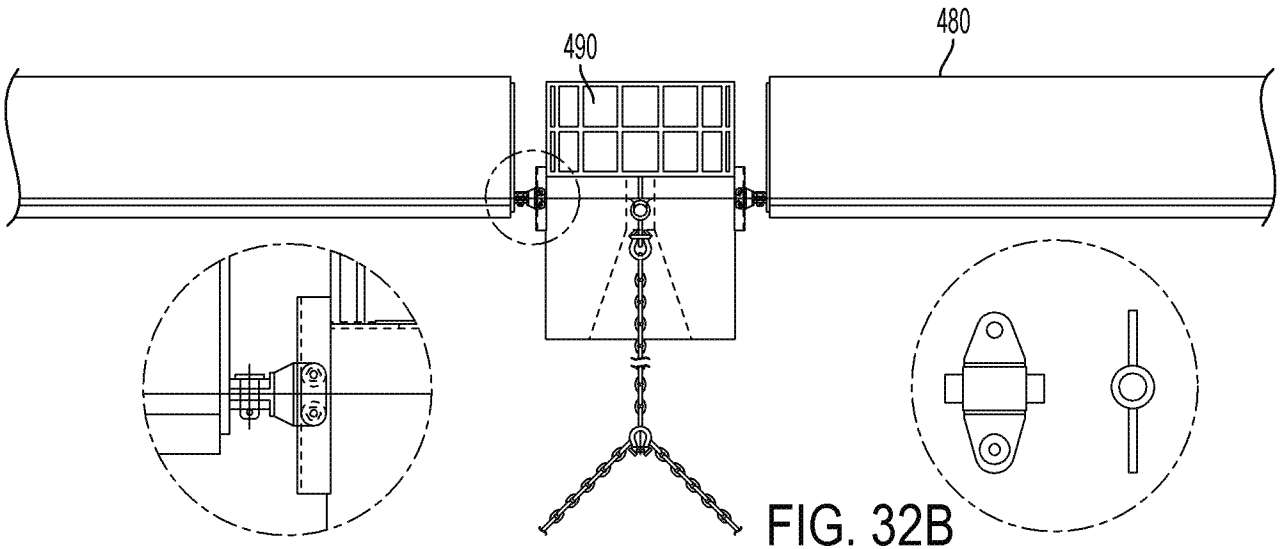
FIG. 32B shows a side view of the hinge portion of FIG. 32A.

In yet another example, as shown in FIGS. 30 and 31, a security barrier system is formed by movable barrier gates 480 that are attached to fixed constructions of the security barrier system by using hinge posts 490. The barrier gates 480 can be opened or closed by tow vessels, or by using motors. The fixed constructions of the security barrier system together with the hinge posts 490 are moored to the sea bed by using any mooring methods.

Unless otherwise stated, all measurements, values, ratings, positions, magnitudes, sizes, and other specifications that are set forth in this specification and drawings, including in the claims that follow, are approximate, not exact. They are intended to have a reasonable range that is consistent with the functions to which they relate and with what is customary in the art to which they pertain.

The scope of protection is limited solely by the claims that now follow. That scope is intended and should be interpreted to be as broad as is consistent with the ordinary meaning of the language that is used in the claims when interpreted in light of this specification and the prosecution history that follows and to encompass all structural and functional equivalents. Notwithstanding, none of the claims are intended to embrace subject matter that fails to satisfy the requirement of Sections 101, 102, or 103 of the Patent Act, nor should they be interpreted in such a way. Any unintended embracement of such subject matter is hereby disclaimed.

Except as stated immediately above, nothing that has been stated or illustrated is intended or should be interpreted to cause a dedication of any component, step, feature, object, benefit, advantage, or equivalent to the public, regardless of whether it is or is not recited in the claims.

It will be understood that the terms and expressions used herein have the ordinary meaning as is accorded to such terms and expressions with respect to their corresponding respective areas of inquiry and study except where specific meanings have otherwise been set forth herein. Relational terms such as first and second and the like may be used solely to distinguish one entity or action from another without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "a" or "an" does not, without further constraints, preclude the existence of additional identical elements in the process, method, article, or apparatus that comprises the element.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separately claimed subject matter.

What is claimed is:

1. A security barrier system including a security barrier unit, the security barrier unit comprising:

a first panel group;

a second panel group; and a connecting member for connecting the first panel group and the second panel group, wherein:

the first panel group and the second panel group are disposed substantially in parallel and face each other, each of the first and second panel groups includes one or more sub-panel groups, each of the sub-panel groups comprising:

barrier panels arranged in line;

intermediate members each disposed between adjacent barrier panels, each of the intermediate members integrated with one of the barrier panels in an undetachable manner;

rope tubes; and one or more ropes, each of the barrier panels has a front face, a rear face and side faces and has channels passing through from one side face to another side face, the rope tubes are disposed in the channels, respectively, so that the rope tubes pass through the barrier panels and the intermediate members, and the barrier panels and the intermediate members are connected by the one or more ropes disposed in at least one of the rope tubes, respectively.

2. The security barrier system of claim 1, wherein the intermediate members include at least one midpoint mooring member having a connection portion for attaching an anchor system for anchoring the security barrier to a sea bed.

3. The security barrier system of claim 1, wherein:

the security barrier unit further comprises an anchor system for anchoring the security barrier to a sea bed, and the intermediate members include at least one midpoint mooring member having a connection portion connected to the anchor system.

4. The security barrier system of claim 1, wherein each of the barrier panels is made of an ablative material which is breakable upon impact.

5. The security barrier system of claim 4, wherein each of the barrier panels has a multilayer structure or a fiberglass structure.

6. The security barrier system of claim 1, wherein each of the sub-panel groups further comprises a strap wound around each of the rope tubes so as to limit motion of the rope tubes during an impact.

7. The security barrier system of claim 6, wherein the strap is made of a polyester webbing.

8. The security barrier system of claim 1, wherein:

each of the sub-panel groups further comprises an end member disposed on an end of each of the sub-panel groups, and the rope tubes are fixed to the end member.

9. The security barrier system of claim 8, wherein each of the rope tubes has a thread end, and is adjustably fixed to the end member by a thread nut for engaging the thread end.

10. The security barrier system of claim 8, wherein:

the end member comprises lugs, each of the lugs having a hole for accommodating a connector pin, and the sub-panel groups are connected by passing through the connector pin into the hole of each of the lugs of adjacent sub-panel groups.

11. The security barrier system of claim 8, wherein the connector pin comprises a core rod surrounded by an elastic material and an outer tube.

12. The security barrier system of claim 1, wherein:

the connecting member includes at least one of a vertical truss and a diagonal truss, the vertical truss is attached between one of the barrier panels in the first panel group and one of the barrier panels in the second panel group, and the diagonal truss is attached between two of the barrier panels in the first panel group and two of the barrier panels in the second panel group.

13. The security barrier system of claim 12, wherein at least one of the vertical truss and the diagonal truss includes two poles connected by two or more struts.

14. The security barrier system of claim 1, wherein the security barrier unit further comprises a cable connecting the first panel group and the second panel group.

15. The security barrier system of claim 1, wherein:

the connecting member includes a pair of wedge-shaped buoys, each of the pair of wedge-shaped buoys has a shorter end and a longer end, and the pair of wedge-shaped buoys are stacked so that the shorter end of one of the pair of wedge-shaped buoys is attached to the longer end of another one of the pair of wedge-shaped buoys.

16. The security barrier system of claim 15, wherein:

each of the pair of wedge-shaped buoys has through holes at each of the shorter end and the longer end, and the rope tubes pass through the through holes, respectively.

17. The security barrier system of claim 1, wherein:

the connecting member includes a plurality of wedge-shaped buoys, each of the plurality of wedge-shaped buoys has a shorter end and a longer end, and the plurality of wedge-shaped buoys are stacked so that shorter ends of the plurality of wedge-shaped buoys are stacked and longer ends of the plurality of wedge-shaped buoys are stacked, respectively, thereby changing a direction of the first and second panel groups.

18. The security barrier system of claim 17, wherein:

each of the plurality of wedge-shaped buoys has through holes at each of the shorter end and the longer end, and the rope tubes pass through the through holes, respectively.

19. The security barrier system of claim 17, wherein each of the plurality of wedge-shaped buoys has a wedge angle substantially equal to 90°/n, n being an integer.

20. The security barrier system of claim 1, further including an opening gate structure having an opening portion, wherein the security barrier unit is disposed so as to open and close the opening portion.

21. The security barrier system of claim 20, wherein the security barrier unit is slidably disposed.

22. The security barrier system of claim 21, wherein the opening gate structure includes two barrier sections, each having a docking station for accommodating the security barrier unit.

23. The security barrier system of claim 21, wherein each docking station includes a winch for pulling a cable attached to the security barrier unit.

24. The security barrier system of claim 23, wherein:

the security barrier unit includes a bridle disposed at ends of the first and second panel groups, and the cable is attached to the bridle.

25. The security barrier system of claim 20, wherein the security barrier unit is hinged to the opening gate structure.

26. The security barrier system of claim 1, wherein each of the barrier panels includes a top portion and a bottom buoyancy portion giving buoyancy to each of the barrier panels.

27. The security barrier system of claim 1, wherein each of the intermediate members includes through holes in which the rope tubes are inserted.

28. A security barrier system including a security barrier unit, the security barrier unit comprising:

a first panel group;

a second panel group; and a connecting member for connecting the first panel group and the second panel group, wherein:

the first panel group and the second panel group are disposed substantially in parallel and face each other, each of the first and second panel groups includes one or more sub-panel groups, each of the sub-panel groups comprising:

barrier panels arranged in line;

intermediate members each disposed between adjacent barrier panels;

rope tubes; and one or more ropes, each of the barrier panels has a front face, a rear face and side faces and has channels passing through from one side face to another side face, the rope tubes are disposed in the channels, respectively, so that the rope tubes pass through the barrier panels and the intermediate members, the barrier panels and the intermediate members are connected by the one or more ropes disposed in at least one of the rope tubes, respectively; and at least one of the one or more ropes has one end fixed to one end of a corresponding one of the rope tubes in which the at least one of the one or more ropes is inserted, and another end adjustably connected to another end of the corresponding one of the rope tubes, so that tension of the at least one of the one or more rope tubes is adjusted.

29. The security barrier system of claim 28, wherein a material of at least one of the rope tubes is different from a material of at least another one of the rope tubes.

30. A security barrier panel unit, comprising one or more sub-panel groups, each of the sub-panel groups comprising:

barrier panels arranged in line;

intermediate members each disposed between adjacent barrier panels, each of the intermediate members integrated with one of the barrier panels in an undetachable manner;

rope tubes; and one or more ropes, each of the barrier panels has a front face, a rear face and side faces and has channels passing through from one side face to another side face, the rope tubes are disposed in the channels, respectively, so that the rope tubes pass through the barrier panels and the intermediate members, and the barrier panels and the intermediate members are connected by the one or more ropes disposed in at least one of the rope tubes, respectively.

31. The security barrier panel unit of claim 30, wherein the intermediate members include at least one midpoint mooring member having a connection portion for attaching an anchor system for anchoring the security barrier to a sea bed.

32. The security barrier panel unit of claim 30, further comprises an anchor system for anchoring the security barrier unit to a sea bed, wherein the intermediate members include at least one midpoint mooring member having a connection portion connected to the anchor system.

33. The security barrier panel unit of claim 30, wherein each of the barrier panels is made of an ablative material which is breakable upon impact.

34. The security barrier panel unit of claim 33, wherein each of the barrier panels has a multilayer structure, a fiberglass structure, or a honeycomb structure.

35. The security barrier panel unit of claim 30, wherein each of the sub-panel groups further comprises a strap wound around each of the rope tubes so as to limit motion of the rope tubes during an impact.

36. The security barrier panel unit of claim 35, wherein the strap is made of polyester, nylon or rubber.

37. The security barrier panel unit of claim 30, wherein:

each of the sub-panel groups further comprises an end member disposed on an end of each of the sub-panel groups, and the rope tubes are fixed to the end member.

38. The security barrier panel unit of claim 37, wherein each of the rope tubes has a thread end, and is adjustably fixed to the end member by a thread nut for engaging the thread end.

39. The security barrier panel unit of claim 37, wherein:

the end member comprises lugs, each of the lugs having a hole for accommodating a connector pin, and the sub-panel groups are connected by passing through the connector pin into the hole of each of the lugs of adjacent sub-panel groups.

40. The security barrier panel unit of claim 37, wherein the connector pin comprises a core rod surrounded by an elastic material and an outer tube.

41. The security barrier panel unit of claim 30, wherein each of the barrier panels includes a top portion and a bottom buoyancy portion giving buoyancy to each of the barrier panels.

42. The security barrier panel unit of claim 30, wherein each of the intermediate members includes through holes in which the rope tubes are inserted.

43. A security barrier panel unit, comprising one or more sub-panel groups, each of the sub-panel groups comprising:

barrier panels arranged in line;

intermediate members each disposed between adjacent barrier panels;

rope tubes; and one or more ropes, wherein:

each of the barrier panels has a front face, a rear face and side faces and has channels passing through from one side face to another side face, the rope tubes are disposed in the channels, respectively, so that the rope tubes pass through the barrier panels and the intermediate members, the barrier panels and the intermediate members are connected by the one or more ropes disposed in at least one of the rope tubes, respectively; and at least one of the one or more ropes has one end fixed to one end of a corresponding one of the rope tubes in which the at least one of the one or more ropes is inserted, and another end adjustably connected to another end of the corresponding one of the rope tubes, so that tension of the at least one of the one or more rope tubes is adjusted.

44. The security barrier panel unit of claim 43, wherein a material of at least one of the rope tubes is different from a material of at least another one of the rope tubes.

* * * * *